US010984996B2

(12) United States Patent
Wang

(10) Patent No.: US 10,984,996 B2
(45) Date of Patent: Apr. 20, 2021

(54) BACKGROUND SUBTRACTION-MEDIATED DATA-DEPENDENT ACQUISTION

(75) Inventor: Xin Wang, Princeton, NJ (US)

(73) Assignee: MassDefect Technologies, LLC, Rocky Hill, NJ (US)

( * ) Notice: Subject to any disclaimer, the term of this patent is extended or adjusted under 35 U.S.C. 154(b) by 876 days.

(21) Appl. No.: 13/822,922

(22) PCT Filed: Jan. 18, 2012

(86) PCT No.: PCT/US2012/021736

§ 371 (c)(1),
(2), (4) Date: Mar. 13, 2013

(87) PCT Pub. No.: WO2012/099971

PCT Pub. Date: Jul. 26, 2012

(65) Prior Publication Data

US 2013/0297226 A1 Nov. 7, 2013

Related U.S. Application Data

(60) Provisional application No. 61/435,257, filed on Jan. 21, 2011.

(51) Int. Cl.
*H01J 49/00* (2006.01)

(52) U.S. Cl.
CPC ..... *H01J 49/0036* (2013.01); *H01J 49/004* (2013.01)

(58) Field of Classification Search
CPC ..... G01N 30/8641; H01J 49/0036
(Continued)

(56) References Cited

U.S. PATENT DOCUMENTS 4,008,388 A * 2/1977 McLafferty ..... G06F 19/703 250/281
5,668,373 A 9/1997 Robbat, Jr. et al.
(Continued)

FOREIGN PATENT DOCUMENTS

CN 101002460 A 7/2007
CN 101256175 A 9/2008
(Continued)

OTHER PUBLICATIONS

Haiying Zhang, An algorithm for thorough background subtraction from high-resolution LC/MS data: application to the detection of troglitazone metabolites in rat plasma, bile, and urine, J. Mass Spectrom. 2008; 43: 1191-1200, Published online Jun. 2, 2008 in Wiley InterScience (www.interscience.wiley.com) DOI: 10.1002/jms.1432.*

(Continued)

*Primary Examiner* — Michael J Dalbo
(74) *Attorney, Agent, or Firm* — Fish & Richardson P.C.

(57) ABSTRACT

This application discloses a background subtraction-mediated data dependent acquisition method useful in mass spectrometry analysis. The method includes subtraction of background data from precursor ion spectra of a sample in real-time to obtain mass data of component(s) of interest and performs data-dependent acquisition on the component(s) of interest based on the resultant mass data from the background subtraction step. The present invention also encompasses mass spectrometer systems capable of background subtraction-mediated data-dependent acquisition and computer programs adapted for use in the background-subtraction-mediated data-dependent acquisition. The invention thus provides highly sensitive data-dependent acquisition for minor components of interest in a sample.

28 Claims, 14 Drawing Sheets

(58) Field of Classification Search
USPC ..... 702/23
See application file for complete search history.

(56) References Cited

U.S. PATENT DOCUMENTS

| | | | | |
|---|---|---|---|---|
| 5,672,869 | A | 9/1997 | Windig et al. | |
| 7,297,941 | B2 | 11/2007 | Senko et al. | |
| 7,351,956 | B2 | 4/2008 | Le Blanc | |
| 7,381,568 | B2 | 6/2008 | Zhang et al. | |
| 7,589,318 | B2 | 9/2009 | Bloomfield et al. | |
| 2004/0108452 | A1 | 6/2004 | Graber et al. | |
| 2004/0181347 | A1 | 9/2004 | Yoshinari et al. | |
| 2005/0048547 | A1* | 3/2005 | Zhao | H01J 49/00 435/6.12 |
| 2005/0230611 | A1 | 10/2005 | Denny et al. | |
| 2005/0261838 | A1 | 11/2005 | Andreev et al. | |
| 2006/0080040 | A1* | 4/2006 | Garczarek | G01N 30/8624 702/19 |
| 2006/0243900 | A1* | 11/2006 | Overney | G01N 33/6848 250/284 |
| 2006/0284067 | A1* | 12/2006 | Senko | G01N 30/8603 250/282 |
| 2006/0284069 | A1* | 12/2006 | Le Blanc | H01J 49/0036 250/282 |
| 2007/0069122 | A1* | 3/2007 | Augustin | G01N 27/622 250/288 |
| 2010/0213368 | A1 | 8/2010 | Wang et al. | |
| 2010/0276586 | A1* | 11/2010 | Senko | H01J 49/0031 250/283 |
| 2011/0049353 | A1* | 3/2011 | Gilbert | G06K 9/0051 250/282 |
| 2011/0288779 | A1* | 11/2011 | Satulovsky | H01J 49/0031 702/19 |

FOREIGN PATENT DOCUMENTS

| | | |
|---|---|---|
| CN | 101256176 A | 9/2008 |
| JP | 2000-131284 | 5/2000 |
| JP | 2000/131284 | 5/2000 |
| JP | 2008-542767 | 11/2008 |
| WO | 2006/130983 | 12/2006 |

OTHER PUBLICATIONS

Haiying Zhang and Yanou Yang, An algorithm for thorough background subtraction from high-resolution LC/MS data: application for detection of glutathione-trapped reactive metabolites, Journal of Mass Spectrometry J. Mass Spectrom. 2008; 43: 1181-1190, Published online Feb. 26, 2008 in Wiley InterScience.*

Zhang, An algorithm for thorough background subtraction from high-resolution LC/MS data: application for detection of glutathione-trapped reactive metabolites, Journal of Mass Spectrometry J. Mass Spectrom 2008; 43: 1181-1190: Published online Feb. 26, 2008 in Wiley InterScience (Year: 2008).*

Dizhao, C. et al., Test and Deduction of Background of Hyphenated Chromatography, *China Academic Journal of Huaihua Teachers College*, (1998), 17(5):47-50.

Kelson, D.D., "Optimal Techniques in Two-dimensional Spectroscopy: Background Subtraction for the 21st Century," *Publications of the Astronomical Society of the Pacific,* (2008), 115:688-699.

Xiaotu, Z., "Background Correction and Resolution of Overlapping Chromatographic Peaks in One-way Chromatography Based on Orthogonal Projections," *Chinese Journal of Analytical Chemistry,* (1999), 27(11):1324-1328.

Zhang, H. et al., "Mass defect profiles of biological matrices and the general applicability of mass defect filtering for metabolite detection," *Rapid Commun. Mass Spectrom,* (2008), 22:2082-2088.

Zhang, H., et al., "An algorithm for thorough background subtraction from high-resolution LC/MS data: application for detection of glutathione-trapped reactive metabolites," *J. Mass Spectrom,* (2008), 43:1181-1190.

Fleming, C.M., et al., "Windowed mass selection method: a new data processing algorithm for liquid chromatography—mass spectrometry data", Journal of Chromatography A, 849 (1999) 71-85.

Kohli, B.M., et al., "An alternative sampling algorithm for use in liquid chromatography/tandem mass spectrometry experiments", Rapid Commun. Mass Spectrom. 2005; 19: 589-596.

Plumb, R.S., et al., "UPLC/MSE; a new approach for generating molecular fragment information for biomarker structure elucidation", Rapid Commun. Mass Spectrom. 2006; 20: 1989-1994.

Zhang, H., et al., "Algorithm for Thorough Background Subtraction of High-Resolution LC/MS Data: Application to Obtain Clean Product Ion Spectra from Nonselective Collision-Induced Dissociation Experiments", Anal. Chem. 2009, 81, 2695-2700.

Zhu, P., et al., "An Accurate-Mass-Based Spectral-Averaging Isotope-Pattern-Filtering Algorithm for Extraction of Drug Metabolites Possessing a Distinct Isotope Pattern from LC-MS Data", Anal. Chem. 2009, 81, 5910-5917.

Zhu, P., et al., "A retention-time-shift-tolerant background subtraction and noise reduction algorithm (BgS-NoRA) for extraction of drug metabolites in liquid chromatography/mass spectrometry data from biological matrices", Rapid Commun. Mass Spectrom. 2009; 23: 1563-1572.

International Search Report issued in International Patent Application No. PCT/US2012/021736 dated Jul. 13, 2012.

Office Action for Japanese Patent Appln 2013-550566 dated Nov. 24, 2015 and its English translation.

European Patent Office, Examination report issued in corresponding EP Application No. 12 736 136.8, dated Apr. 13, 2017 (21 pages).

Office Action issued in corresponding Japanese Patent Application No. 2013-550566 dated Jul. 26, 2016 with English translation.

* cited by examiner

Acquired spectrum

Background spectra

Background-subtracted spectrum scan #1
c selected for DDA scan #2
a selected for DDA scan #3
b selected for DDA scan #4
c selected for DDA scan #5
a selected for DDA scan #6
b selected for DDA
100
50
0
a
b
c
500
550
600
650
700
m/z

BACKGROUND SUBTRACTION-MEDIATED DATA-DEPENDENT ACQUISTION

CROSS-REFERENCE TO RELATED APPLICATIONS

This application is a national phase application under 35 U.S.C. § 371 of International application number PCT/US2012/021736, filed Jan. 18, 2012, which claims priority under 35 U.S.C. § 119(e) to U.S. Provisional Patent Application Ser. No. 61/435,257, filed on Jan. 21, 2011, which is hereby incorporated by reference in its entirety.

FIELD OF THE INVENTION

The present invention relates to a novel method and system for data-dependent acquisition of samples based on background-subtracted mass spectrometric information.

BACKGROUND OF THE INVENTION

A precise and thorough background subtraction method is described in US 20100213368, which is hereby incorporated by reference in its entirety. The method uses a sample dataset and one or a few of its control datasets to reduce chemical noise and irrelevant signals in the sample matrix so that components of interest in the sample could be effectively identified. Also described is a form of this method for effective identification of fragment ions of components of interest. This was achieved using non-specific fragmentation data acquired for the sample and its controls. Non-specific fragmentation data could be obtained using techniques such as in-source fragmentation or $MS^E$ (see, e.g., Plumb, et al., RCMS, 2006, 20:1989-1994). The fragment ions of a component of interest could be correlated to its corresponding precursor/molecular ions based on their comparable retention time and chromatographic profiles. However, chromatographic correlations between fragment ions and their precursor ions would not be definitively ascertainable in cases where several components co-eluted and multiple possible molecular ions exhibited. In such situation it would be desirable to have hardware-based, true MS/MS data available to unambiguously correlate fragment ions with their respective precursor ions.

Hardware-based MS/MS technique, or tandem mass spectrometry, is a technique where specific precursor ions in a mass spectrometer are first selected and then activated and fragmented, followed by recording of fragmented ions (a.k.a. product ions) of the specific precursor ions. In contrast to the aforementioned chromatographic correlation of non-specific fragmentation data with their potential precursor ion data, in data obtained with MS/MS experiments the relationship between fragment ions and their corresponding precursor ions are concrete and specific. Fragment ion information obtained in MS/MS experiments is useful for confirmation and structural elucidation of their respective precursor ions. MS/MS experiments are carried out with individual acquisition functions designed on individual expected precursor ions. However, this may require multiple sample injections for multiple precursor ions. In addition, it requires prior knowledge of expected precursor ions of interest to get their respective MS/MS data. An alternative is to conduct MS/MS acquisition in data-dependent mode so that MS/MS data are obtained for multiple components in one scan function without presetting specific precursor ions.

In a data-dependent MS/MS acquisition mode (DDA MS/MS), in order to obtain MS/MS data for different precursor ions of potential interest, typically a criterion is applied to examining the mass spectrum of a precursor ion acquisition (PIA) scan acquired at a chromatographic time point (either from a regular scan event or a survey scan event) to make real-time decision on (1) whether any precursor ion in the spectrum is worthy of selection, and (2) which precursor ion(s) is(are) to be selected for the subsequent MS/MS scans. For example, in some embodiments, criteria are set to determine the most intense ions in the precursor ion mass spectrum and to trigger MS/MS scans on the determined most intense ions. In other embodiments, assisting methods of, e.g., dynamic list exclusion or dynamic background exclusion (see, e.g., U.S. Pat. Nos. 7,351,956 and 7,297,941) are applied to further increase the opportunity of obtaining MS/MS data for more components by way of preventing and/or limiting repetitive selection of the same precursor ions (e.g., intense background ions) over a wide chromatographic time range. However, all the aforementioned DDA criteria in themselves do not differentiate between components of interest and those of non-interest, e.g., irrelevant signals from sample matrix. Therefore, the handling of the resultant MS/MS data obtained in such manners is often challenging because of an overwhelming number of irrelevant MS/MS spectra of precursor ions of sample matrix components. In addition, despite increased chances of obtaining MS/MS data for more components, precursor ions of components of interest that have relatively low intensities may still miss triggering MS/MS scans due to the presence of higher intensity sample matrix components and the limitation of instrument duty cycle. Therefore, development of a system or method that could subtract background data and acquire only or substantially only mass data of components of interests is highly desirable and needed.

SUMMARY OF THE INVENTION

The present invention fulfills the foregoing need by disclosing a method and system to conduct background subtraction of precursor ion spectra in real-time to remove irrelevant signals (e.g., those of sample matrix components) and to perform data-dependent acquisitions based on the background-subtracted spectral information.

In one aspect the present invention provides a mass spectrometer system comprising: (a) a data-dependent acquisition module comprising a mass data acquisition unit; and (b) a background subtraction module comprising a computing unit, wherein the background subtraction module is capable of subtracting mass data of background components (the "background data") from a mass dataset of a sample comprising the background components, wherein mass data acquisition by the data-dependent acquisition module is mediated by the background subtraction module.

In another aspect, the present invention provides a mass spectrometer system comprising: (a) a means for acquiring a mass spectrum dataset of a sample in a data acquisition event based on a peak identified in an earlier data acquisition event (data-dependent acquisition); and (b) a means of subtracting background data from a sample dataset, wherein ion signals of non-interesting background components are substantially removed so that ions of component(s) of interest in the sample become prominent, thus allowing selective and sensitive data-dependent acquisitions of only component(s) of interest, and the dataset resulted from the background subtraction consists essentially of relevant data of the components of interest.

In another aspect, the present invention provides a method of analyzing mass spectrum of a sample, comprising the steps of: (a) acquiring an original mass spectrum of the sample with a first mass spectrometric acquisition function at a chromatographic time point, wherein the original mass spectrum comprises m/z and intensity information of detected ion peaks at the chromatographic time point; and (b) conducting background subtraction for ions in the original mass spectrum using ion information in a background data set, generating a current background-subtracted mass spectrum.

In another aspect, the present invention provides a system for analyzing samples, comprising: (a) a separation module to separate ions of components in a sample; (b) a mass spectrometer to detect ions of components in the sample; (c) a data-dependent acquisition module; and (d) a system controller comprising a background-subtracting module, configured to execute instructions that cause the system to perform data-dependent acquisition.

The present invention may have one or more of the following advantages: (a) It allows data-dependent MS/MS acquisition and/or other types of data-dependent acquisitions, e.g., data-dependent sampling, to be conducted selectively on components of interest instead of, e.g., sample matrix components. Such components of interest are typically unknown before an analysis of the number of them in the sample and their identity and quantity. (b) Consequently, it offers better DDA sensitivity for minor components of interest. (c) It enables the use of real-time base peak ion chromatogram or total ion chromatogram, in addition to information of ion signals of specific m/z values, to mediate data-dependent acquisitions on components of interest. (d) It allows the resultant data of data-dependent MS/MS acquisitions to display peak shapes of the eluting components, which are correlated to, or compared with, the precursor ion profiles, or the UV, radio-chromatographic, or other profiles of the sample analysis for identification or other purposes. (e) It allows the resultant dataset of data-dependent MS/MS acquisitions to be much smaller, yet more relevant. (f) It provides the flexibility to tailor an analysis according to a user's need to selectively conduct data-dependent acquisitions on a particular subset of components of interest. Such components of interest are typically unknown in number in the sample and their identity and quantity.

These and other aspects and advantages of the present invention will be better appreciated by reference to the following drawings and detailed description.

DETAILED DESCRIPTION OF THE INVENTION

Figure 1A:
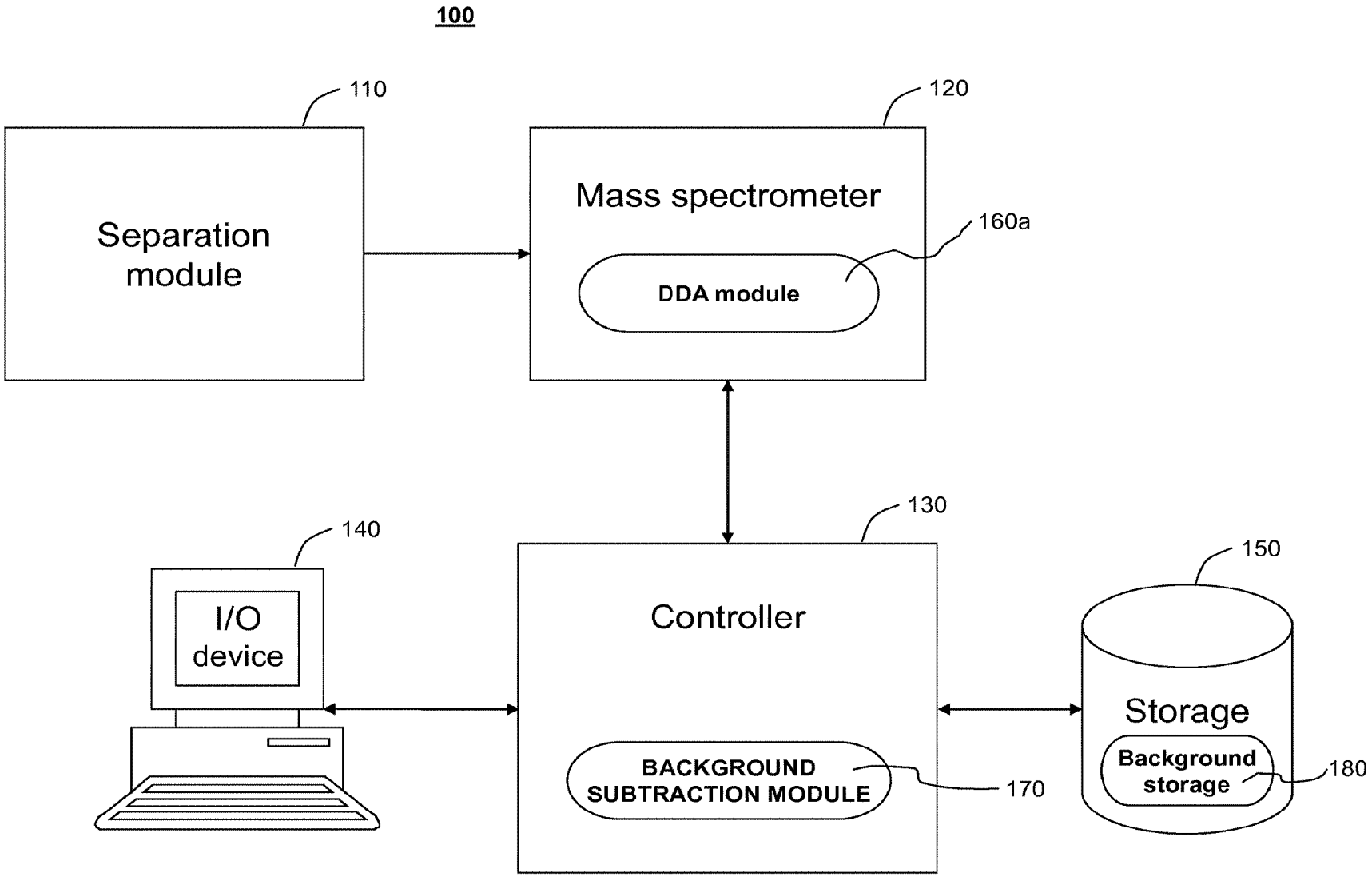
FIGS. 1*a*-1*d* are four schematic diagrams of an apparatus made for applications in data-dependent acquisitions.

In one aspect, the present invention provides a mass spectrometer system comprising:

(a) a data-dependent acquisition module comprising a mass data acquisition unit; and (b) a background subtraction module comprising a computing unit, wherein the background subtraction module is capable of subtracting mass data of background components (the "background data") from a mass dataset of a sample comprising the background components, wherein mass data acquisition by the data-dependent acquisition module is mediated by the background subtraction module.

In one embodiment of this aspect, the subtracting event occurs each time before performing an immediate subsequent data-dependent data acquisition event of the sample.

In another embodiment of this aspect, the subtracting event includes removing or substantially removing mass signals of the background components from mass signals of the sample using a computing algorithm.

In another embodiment of this aspect, the background data is acquired immediately prior to acquisition of the sample dataset.

In another embodiment of this aspect, the system further includes a data storage module where the background data is pre-stored prior to acquisition of the sample dataset.

In another embodiment of this aspect, the background subtraction module accepts the sample dataset from the data-dependent acquisition module, retrieves the background data from the data storage module, and subtracts the background data from the sample dataset by operation of a computing algorithm.

In another embodiment of this aspect, the sample dataset is a precursor or parent mass dataset of the sample.

In another embodiment of this aspect, the background subtraction module subtracts the background data from the sample dataset to generate a new mass dataset consisting essentially of mass data of component(s) of interest, and the new mass dataset determines choice of mass signal(s) used to direct an immediate subsequent data scan event.

In another embodiment of this aspect, the choice of mass signal(s) is defined as the current highest intensity mass signal(s) in the new mass dataset.

In another embodiment of this aspect, the choice of mass signal(s) is selected from current fast-rising mass signals or otherwise distinctive mass signal(s) in the new mass dataset.

In another embodiment of this aspect, the choice of mass signal is selected based on the fast rising or otherwise distinctive characteristics of the base peak ion chromatogram of in the new mass dataset.

In another embodiment of this aspect, the immediate subsequent data scan event is an MS/MS acquisition event In another embodiment of this aspect, the immediate subsequent data scan event is a sample fractionation event generating fractions for further analysis.

In another embodiment of this aspect, the further analysis is selected from $MS^n$, MS/MS, and NMR.

In another embodiment of this aspect, the subtracting event includes subtracting a plurality of background data from a plurality of sample datasets before acquiring a plurality of subsequent data-dependent datasets of the sample through interaction between the data-dependent acquisition module and the background subtraction module.

In another embodiment of this aspect, the data-dependent acquisition of mass data is triggered by a data event obtained in the computing unit of the background subtraction module by operation of a computing algorithm.

In another embodiment of this aspect, the computing algorithm conducts subtraction or contrasting between ion peak intensities in the sample dataset and ion peak intensities in a background dataset for corresponding components.

In another embodiment of this aspect, the contrasting step includes dividing ion peak intensities in the sample dataset by corresponding ion peak intensities in the background dataset or dividing ion peak intensities in the background dataset by corresponding ion peak intensities in the sample dataset, said dividing giving a result expressed as percentile or ratio as the trigger for the next data event.

In another embodiment of this aspect, the intensities of the background data are multiplied by a scale factor before conducting the subtracting or contrasting.

In another embodiment of this aspect, the scale factor is determined by concentration or potency differences between a sample tested and corresponding background control.

In another embodiment of this aspect, the background data and the sample dataset are high-resolution mass spectrometric datasets.

In another embodiment of this aspect, the background data contains information about m/z of ions, chromatographic time, and peak intensity of a control sample consisting essentially of non-interesting background components.

In another embodiment of this aspect, the system is an LC-MS/MS system.

In another embodiment of this aspect, the system includes a high-resolution mass spectrometer.

In another aspect, the present invention provides a mass spectrometer system comprising: (a) a means for acquiring a mass spectrum dataset of a sample in a data acquisition event based on a peak identified in an earlier data acquisition event (data-dependent acquisition); and (b) a means of subtracting background data from a sample dataset, wherein ion signals of non-interesting background components are substantially removed so that ions of component(s) of interest in the sample become prominent, thus allowing selective and sensitive data-dependent acquisitions of only component(s) of interest, and the dataset resulted from the background subtraction consists essentially of relevant data of the component(s) of interest.

In one embodiment of this aspect, the system further includes a means of reconstructing a current background-subtracted mass spectrum of the sample, wherein the current background-subtracted mass spectrum determines ions to be selected for data acquisition by the acquiring means, and wherein the original mass spectrum is selected at a specified chromatographic time point.

In another embodiment of this aspect, the reconstructing means includes a computing algorithm that removes or substantially removes the background data from the original mass spectrum of a sample tested.

In another embodiment of this aspect, the acquiring means includes a data-dependent acquisition module, and the subtracting means comprises a background subtraction module.

In another embodiment of this aspect, the system includes an LC-MS/MS system.

In another embodiment of this aspect, the system includes a high-resolution mass spectrometer.

In another aspect, the present invention provides a method of analyzing mass spectrum of a sample, comprising the steps of:

(a) acquiring an original mass spectrum of the sample with a first mass spectrometric acquisition function at a chromatographic time point, wherein the original mass spectrum comprises m/z and intensity information of detected ion peaks at the chromatographic time point; and (b) conducting background subtraction for ions in the original mass spectrum using ion information in a background data set, generating a current background-subtracted mass spectrum.

In one embodiment of this aspect, the ion signals of non-interesting component(s) are substantially removed from the current background-subtracted spectrum, and ions of components of interest in the sample become prominent, thus allowing selective and sensitive data-dependent acquisitions for component(s) of interest.

In another embodiment of this aspect, the method further includes a step of (c) defining sections of data in the background data set at the chromatographic time and m/z dimensions specified in step (a).

In another embodiment of this aspect, the defining step includes applying a chromatographic fluctuation time window and a mass precision window around the ions in the original mass spectrum at the chromatographic time point.

In another embodiment of this aspect, the chromatographic fluctuation time window and said mass precision window are variable windows.

In another embodiment of this aspect, the current background-subtracted mass spectrum is obtained through reconstruction of the original mass spectrum at the chromatographic time point after subtracting the background data from corresponding sections of the original mass spectrum comprising the data of background components.

In another embodiment of this aspect, the background subtraction is carried out by a first means of retrieving the background data from a data storage and subtracting the background data from the original dataset of the sample.

In another embodiment of this aspect, the first means includes a background subtraction module.

In another embodiment of this aspect, the method further includes determining an event of a second data-dependent acquisition function following the chromatographic time point based on the information of the current background-subtracted mass spectrum.

In another embodiment of this aspect, the determining step is implemented by a second means of computing instructions for the second data-dependent acquisition function based on the information of the current background-subtracted mass spectrum.

In another embodiment of this aspect, the second means includes a data-dependent acquisition module.

In another embodiment of this aspect, the mass spectrometric acquisition function is kept the same or equivalent for acquisition of the background dataset and acquisition of the original mass dataset of the sample so that non-interesting components in both datasets have same or similar ion populations.

In another embodiment of this aspect, prior to step (a) or (b), the method further includes the steps of:

(e) obtaining at least one background data set comprising information on m/z of ions, chromatographic time, and peak intensity;

(f) specifying a chromatographic fluctuation time window and a mass precision window; and (g) conducting a separation and mass spectrometry analysis on the sample to be tested, wherein said analysis comprises the first mass spectrometric acquisition function.

In another embodiment of this aspect, the sample is a biological sample.

In another embodiment of this aspect, the biological sample contains an active pharmaceutical ingredient or metabolite(s) thereof.

In another embodiment of this aspect, the biological sample contains one or more components of interest selected from drugs of abuse, metabolites, pharmaceuticals, forensic chemicals, pesticides, peptides, proteins, and nucleotides.

In another embodiment of this aspect, the biological sample contains a plurality of components in the background that are difficult to separate from the component(s) of interest.

In another aspect, the present invention provides a method of analyzing a sample using a mass spectrometer, comprising:

(a) obtaining a background data set comprising information on m/z of ions, chromatographic time, and mass peak intensity;

(b) analyzing mass spectrometry of the sample, using at least a first mass spectrometric acquisition function;

(c) acquiring an original mass spectrum of the first mass spectrometric acquisition function at a chromatographic time point, the original mass spectrum comprising m/z and intensity information of ions detected at the chromatographic time point;

(d) defining sections of data in the background data set in chromatographic time and m/z dimensions;

(e) subtracting ions in the original mass spectrum at the chromatographic time point using a first means based on ion information in corresponding sections of the background data set; and (f) deciding an event of a second data-dependent acquisition function using a second means following the chromatographic time point, the second means comprising computing instructions for deciding said event based on information of the current background-subtracted mass spectral information of the first mass spectrometric acquisition function;

whereby ion signals of non-interesting components are substantially removed from the current background-subtracted spectra of the first mass spectrometric acquisition function, and ions of components of interest in the sample become prominent, thus allowing selective and sensitive data-dependent acquisitions for components of interest.

In one embodiment of this aspect, the defining step includes applying a chromatographic fluctuation time window and a mass precision window around the ions in the original mass spectrum at the chromatographic time point.

In another embodiment of this aspect, the method further includes specifying the chromatographic fluctuation time window and the mass precision window prior to applying them around ions in the original mass spectrum at the chromatographic time point.

In another embodiment of this aspect, the sample is a biological sample.

In another embodiment of this aspect, the biological sample contains an active pharmaceutical ingredient or metabolite(s) thereof.

In another embodiment of this aspect, the biological sample contains one or more components of interest selected from drugs of abuse, metabolites, pharmaceuticals, forensic chemicals, pesticides, peptides, proteins, and nucleotides.

In another embodiment of this aspect, the biological sample contains a plurality of components in the background that are difficult to separate from the component(s) of interest.

In another aspect, the present invention provides a system for analyzing a sample, comprising:

a separation module to separate ions of components in a sample;

a mass spectrometer to detect ions of components in the sample;

a data-dependent acquisition module; and a system controller comprising a background-subtracting module, configured to execute instructions that cause the system to perform a method according to any of the embodiments disclosed herein.

In one embodiment of this aspect, the sample contains components of interest and non-interesting background components, and the non-interesting background components are substantially the same as the components in a background control sample.

Other aspects or embodiments will be described in more details in other sections. As will be appreciated by a person of skill in the art, other aspects embodiments of the present invention may include any suitable combinations of the embodiments disclosed herein.

Definitions

The term "mass spectrum," as used herein, refers to mass spectrometric information at a given chromatographic time point, comprising m/z and associated intensity attributes of ion signals. (The intensity attributes can be expressed in either relative or absolute forms).

The term "scan," as used herein, refers to an event of acquisition or other action at a chromatographic time point, e.g., an event of acquiring a mass spectrum at a chromatographic time point, or an event of instructing a sampling device to perform an action to the chromatographic effluent at a chromatographic time point (e.g., switching the sampling device on or off).

The term "scan function," as used herein, refers to the type of mass spectrometric acquisition (or other acquisitions/actions including non-mass-spectrometric actions to the chromatographic effluent) performed in an analysis. There can be more than one scan function for the duration of an analysis. For example, in a data-dependent workflow, there can be a precursor ion acquisition (PIA) scan function and a data-dependent acquisition (DDA) scan function. Each scan function can have a number of scan events and the scan events are typically annotated with sequential scan numbers (e.g. 1, 2, 3, 4, etc.). Typically the scan numbers annotating the scan events of a scan function are associated with and represent the chromatographic time attributes of the scan events. In a data-dependent workflow, the scan events of a DDA function, if any, would typically follow the scan events of a PIA function. For example:

PIA1/DDA1, PIA2/DDA2, PIA3/DDA3, PIA4/DDA4, PIA5/DDA5, . . . ; or

PIA1/noDDA, PIA2/noDDA, PIA3/DDA1, PIA4/noDDA, PIA5/DDA2, . . . ; etc.

The term "data" or "dataset" of a mass spectrometric acquisition function, as used herein, refers to mass spectrometric information acquired of that scan function, typically comprising time, m/z, and intensity attributes of ion signals (expressed in either relative or absolute forms).

The term "data-dependent acquisition function," as used herein, refers to a mass spectrometric acquisition function or a non-mass-spectrometric function (e.g. sampling) whose scan events are executed based on current information of dataset of a "parent" mass spectrometric acquisition function (which typically is referred to as a precursor ion acquisition function). Data-dependent acquisition function includes but is not limited to MS/MS acquisition function.

MS/MS acquisition function, or tandem mass spectrometric scan function, is a technique where specific precursor ions are first selected in a mass spectrometer and then activated and fragmented, followed by recording of fragmented ions (a.k.a. product ions) of the specific precursor ions.

The term "data-dependent MS/MS acquisition function," as used herein, refers to a mode of DDA function where in order to obtain MS/MS data for different precursor ions, a criterion is applied to examining the data of a precursor ion acquisition function to make real-time decision on whether any precursor ion is worthy of selection at the moment, and/or which precursor ion(s) is(are) to be selected for the subsequent MS/MS scan events.

The term "background data," as used herein, refers to dataset(s) that are other than the dataset of a precursor ion acquisition scan function but dataset(s) that are fed (to a background subtraction module) to enable real-time background subtraction of the dataset of a precursor ion acquisition scan function. Background data typically comprise m/z and intensity attributes of ion signals that would not be of interest for triggering data-dependent acquisition purpose if the equivalent ion signals were also presented in the dataset of a precursor ion acquisition scan function.

The term "background subtraction," as used herein, refers to the operation of real-time contrasting of the dataset of a precursor ion acquisition scan function against the background data for the purpose of de-emphasizing/cancelling out ion signals that are not of interest and thus highlighting/emphasizing ion signals that are of interest for directing relevant data-dependent acquisitions, wherein the operation of real-time contrasting typically involves, but is not limited to, intensity-subtraction, intensity-division, ion signal zeroing-out, or any other computational operations or variations thereof, as will be illustrated in some embodiments of this disclosure.

The term "means of subtracting background data from a sample dataset," as used herein, refers to a means comprising methods or systems enabling the above mentioned "background subtraction" operations.

The term "current background-subtracted mass spectrum," as used herein, refers to the outcome data of the operation of background-subtraction on the mass spectrum obtained from a precursor ion acquisition function at the latest chromatographic time point, comprising m/z and associated intensity attributes of the processed ion signals (expressed in either relative or absolute forms) at this chromatographic time point.

The term "background-subtracted dataset" (a.k.a. "new mass dataset" or "background-subtracted spectral information") of a precursor ion acquisition function, as used herein, refers to data comprising all or part of the background-subtracted mass spectra of the precursor ion acquisition function up to the current background-subtracted mass spectrum, along with their time attributes.

The term "current highest intensity mass signal(s)" of a background-subtracted dataset, as used herein, refers to the ion signal(s) of the current background-subtracted mass spectrum whose associated intensity attributes are highest among ion signals in the current background-subtracted mass spectrum.

The term "dynamic exclusion list," as used herein, refers to an existing DDA technique wherein m/z information of precursor ions having recently triggered data-dependent scans is stored in a temporary exclusion list so that the information is used to prevent continuous selection of the same high intense ions in the near moment and thus allowing other precursor ions not on the list (typically of lower intensities in a mass spectrum) to have opportunity of being selected for data-dependent acquisition.

The term "dynamic background signal exclusion," as used herein, refers to an existing DDA technique wherein fast rising or otherwise distinctive attributes of ion signals in a dataset of a precursor ion acquisition function are characterized and are used to trigger data-dependent acquisition (U.S. Pat. Nos. 7,351,956, 7,297,941 or Kohli, et al., *Rapid Commun. Mass Spectrom.,* 2005, 19:589-596), and thus allowing more ions the opportunity of triggering data-dependent acquisitions.

The term "base peak intensity," as used herein, refers to the highest intensity value of ion signals in a mass spectrum. The term "base peak ion chromatogram" or "BPI", as used herein, refers to a temporal profile of dataset from a mass spectrometric acquisition function depicting the temporal change of base peak intensities along the chromatographic time scale. Fast rising or otherwise distinctive attributes of base peak intensity changes can be characterized in like way to those disclosed in, e.g., U.S. Pat. No. 7,297,941 for characterizing fast rising or otherwise distinctive attributes of individual ion signals.

The term "total ion intensity," as used herein, refers to the sum of intensities of all ion signals in a mass spectrum. The term "total ion chromatogram" or "TIC", as used herein, refers to a temporal profile of dataset from a mass spectrometric acquisition function depicting the temporal change of total ion intensities along the chromatographic time scale, Fast rising or otherwise distinctive attributes of total ion intensity changes can be characterized in like way to those disclosed in, e.g., U.S. Pat. No. 7,297,941 for characterizing fast rising or otherwise distinctive attributes of individual ion signals.

The term "means for data-dependent acquisition," in accordance with the present invention, refers to a means making use of "background-subtracted dataset" (a.k.a. "new mass dataset" or "background-subtracted spectral information") of a precursor ion acquisition function to mediate the events of at least one data-dependent acquisition function. Therefore, the means hereby incorporates in entirety any methods or systems that use mass spectrometric information obtained from a precursor ion acquisition function to instruct the execution of data-dependent acquisition/action events.

The term "test sample," as used herein, refers to any sample that is the subject of an analysis comprising at least one "data-dependent acquisition function".

The term "components of interest," as used herein, refers to analytes in a test sample whom are targeted after by purpose of the analysis. In accordance with the present invention, for ions of components of interest, their equivalent ion signals in background data (in corresponding time and m/z sections) typically are not present or present with significantly lower intensity. Examples of "Components of interests" in a test sample include, but are not limited to, pharmaceuticals, drug metabolites, degradants, impurities, proteins, peptides, lipids, sugars, acids, bases, pollutants, industrial chemicals, drug-of-abuse, pesticides, forensic chemicals, xenobiotics, etc.

The term "non-interesting components" refers to components other than "components of interest" in a test sample, whose equivalent ion signals typically present at comparable levels in background data as well.

The term "biological sample," as used therein, refers to an exemplary type of "test sample" which comprises "non-interesting components" derived from biochemical or related sources (including but not limited to bile, urine, plasma, body fluid, feces, tissue or cell homogenates, microsomal or enzymatic incubates, plant or vegetable extracts, natural product extracts, formulation or vehicles, etc.).

Preferred Embodiments

Figure 1B:
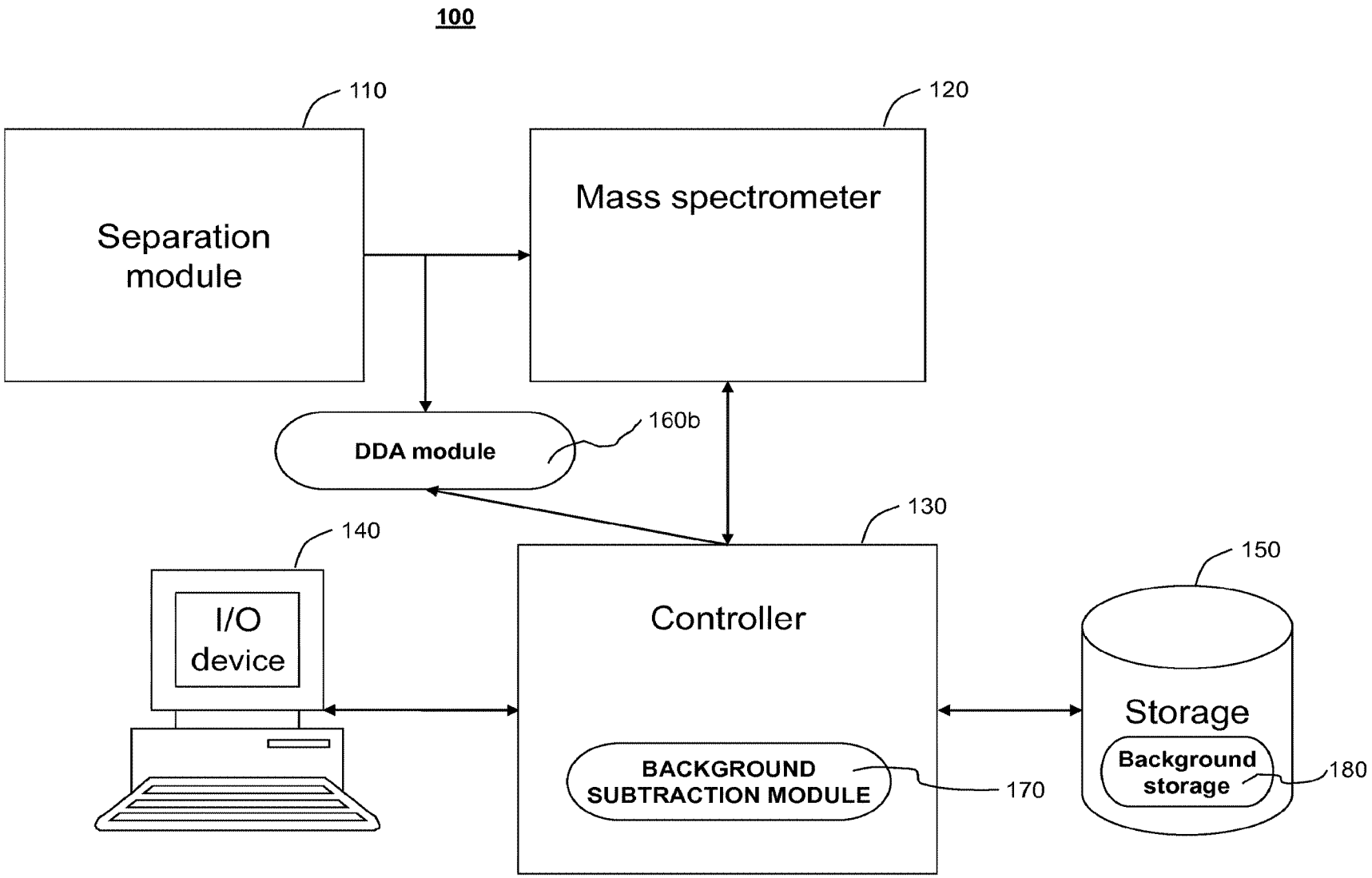
Figure 1C:
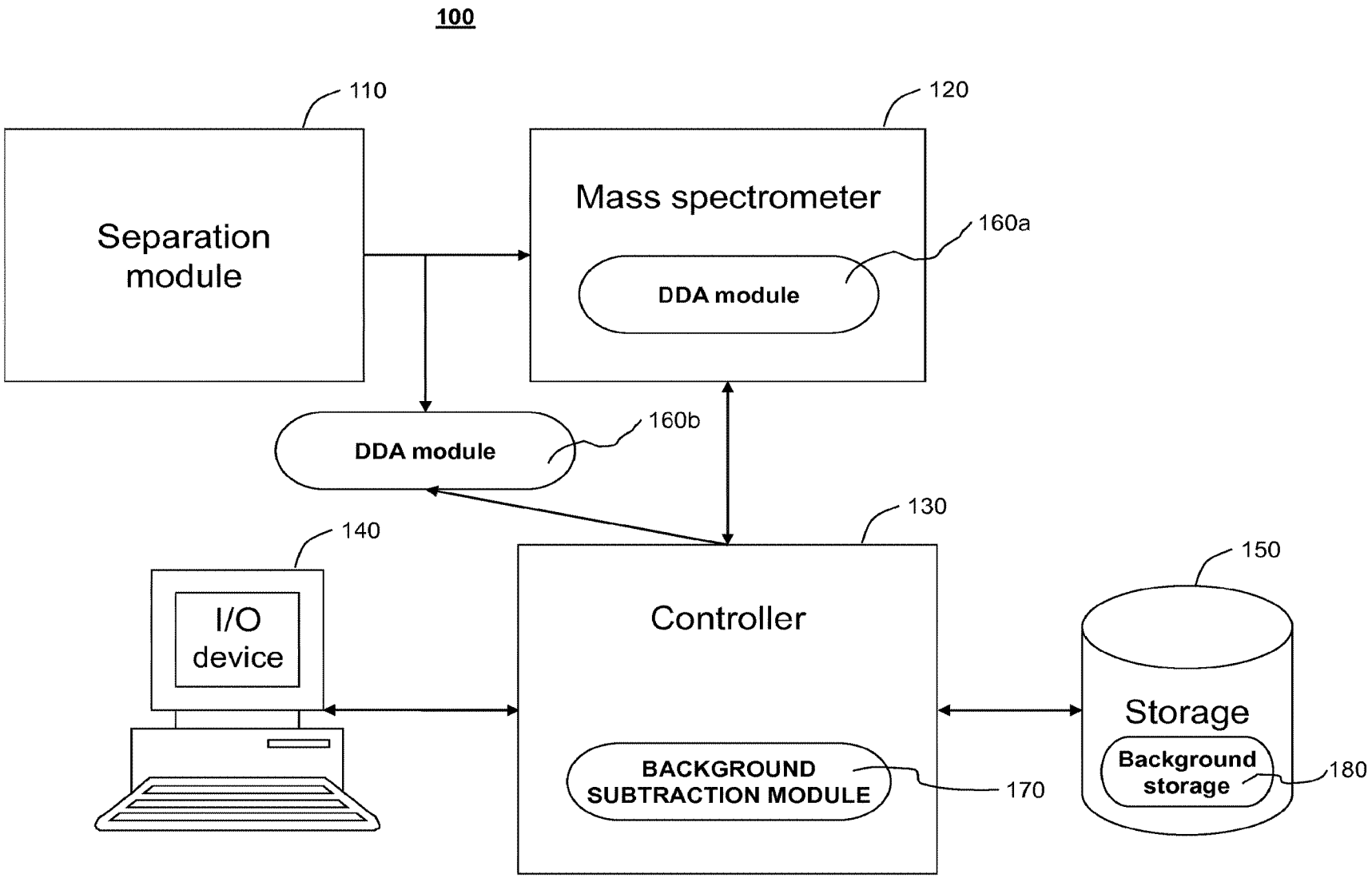

FIGS. 1*a*-1*c* illustrate typical basic components of an apparatus 100 for background subtraction-mediated data-dependent acquisition. In one embodiment illustrated in FIG. 1*a*, it comprises a separation module 110 coupled to a mass spectrometer 120 and a system controller 130 for controlling the separation module 110 and the mass spectrometer 120. An input/output (I/O) device 140 (typically including an input component such as a keyboard or control buttons, and an output component such as a display) is operatively coupled to the controller 130. A data storage 150 is also provided. The mass spectrometer 120 preferably comprises a DDA module 160*a* to conduct data-dependent mass spectrometric acquisitions, e.g. MS/MS acquisition. The system controller 130 is adapted for computing and defining a set of instructions to control the data-dependent acquisition. The controller 130 preferably comprises a background subtraction module 170 configured for obtaining background-subtracted spectra in real-time to mediate the data-dependent acquisition. The data storage 150 comprises a background storage 180 containing background data that are retrieved by the background subtraction module 170.

The mass spectrometer 120 preferably comprises a mass analyzer of relatively high mass resolution power, including, e.g., a time-of-flight type or a Fourier transform type (including Orbitrap™) of mass analyzer, as known in the art. The separation module 110 is a liquid chromatography (LC), a gas-phase chromatography (GC), a capillary electrophoresis (CE), or other device that separates components of a sample and elutes them in a time-differentiated manner. The controller 130 can comprise any data-acquisition and processing system(s) or device(s) suitable for accomplishing purposes described in this application. For example, it can comprise a suitably-programmed or—programmable general- or special-purpose computer or other automatic data processing equipment, with associated programming and data acquisition and control devices. For example, it can comprise one or more automatic data processing chips adapted for automatic and/or interactive control by appropriately-coded structured programming, including one or more application and operating system programs, and any necessary or desirable volatile or persistent storage media.

In one embodiment, the aforementioned data-dependent mass spectrometric acquisition is a MS/MS acquisition performed via the DDA module 160*a* in the mass spectrometer 120. The DDA module 160*a* in this embodiment comprises an ion-selection and fragmentation device such as an ion trap or a collision cell that performs a MS/MS acquisition. Events of the MS/MS acquisition, including the precursor ion selection and their fragmentation and product ion-recording are controlled by a set of instructions computed and defined in the controller 130, where some of the instructions are computed and defined based on the current background-subtracted mass spectral information obtained in the background subtraction module 170.

In another embodiment, the aforementioned data-dependent mass spectrometric acquisition performed via the DDA module 160*a* in the mass spectrometer 120 is a mass spectrometric acquisition function other than a MS/MS acquisition function. For example, in some embodiments, the data-dependent acquisition function is an opposite mode of ion generation (e.g. negative ionization vs. positive ionization) or an $MS^n$ acquisition on an ion trap device. Events of the data-dependent acquisition function, e.g. the decision to trigger the acquisition and the way to accomplish the acquisition, are controlled by a set of instructions computed and defined in the controller 130, where some of the instructions are computed and defined using the current background-subtracted mass spectral information obtained in the background subtraction module 170.

Figure 1D:
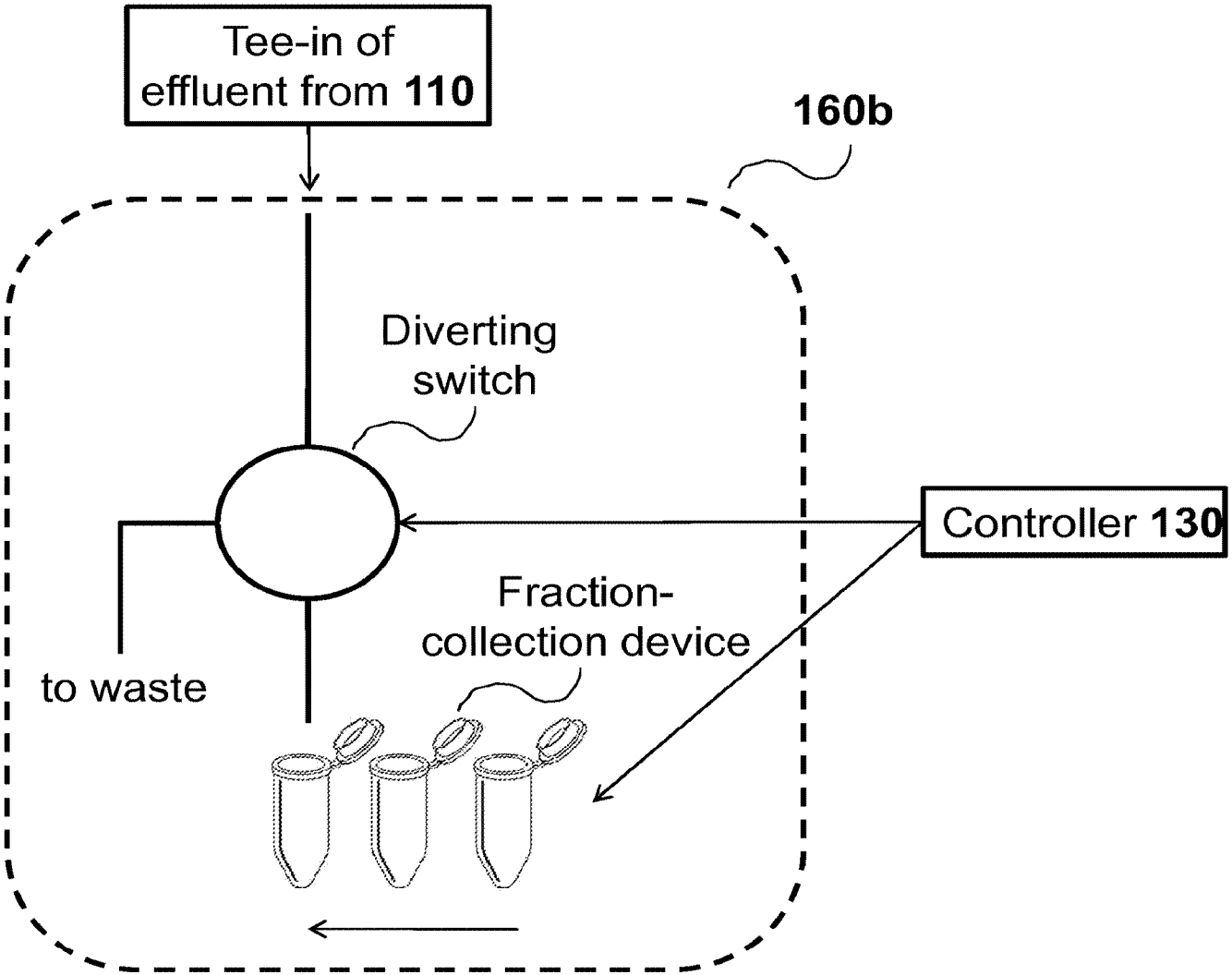

In another embodiment illustrated in FIG. 1*b*, the apparatus 100 may comprise a DDA module 160*b* outside of the mass spectrometer 120, instead of the DDA module 160*a* within the mass spectrometer 120. The data-dependent acquisition is performed outside of the mass spectrometer 120 via the DDA module 160*b*. The separation module 110 is coupled to both the mass spectrometer 120 and the DDA module 160*b*, via, e.g., a chromatographic effluent splitter. The system controller 130 is coupled to the mass spectrometer 120 and the DDA module 160*b* for controlling the mass spectrometer 120 and the DDA module 160*b*. The data-dependent acquisition function is a data-dependent sampling or other analysis of the chromatographic effluents performed by the DDA module 160*b*. Events of the data-dependent sampling function, including the timing to decide sampling or discarding the chromatographic effluents are controlled by a set of instructions computed and defined in the controller 130, where some of the instructions are computed and defined based on the current background-subtracted mass spectral information obtained in the background subtraction module 170. In one embodiment, the DDA module 160*b* is a device separate from the mass spectrometer 120, and performs a sampling or other analysis of the chromatographic effluents from the separation module 110. For example, in one embodiment, it is a second mass spectrometer performing a different type of mass spectrometric acquisition, e.g. an opposite mode of ionization polarity. In another embodiment, it is a fractionation device, being either a multiple-well plate format or an individual vial format, for collection of eluted components of interest for a follow-up analysis. FIG. 1*d* illustrates one of such fractionation device which comprises an effluent diverting switch and a moving fraction-collecting device, both of which are coupled with the system controller 130 and decisions on sampling or discarding the chromatographic effluents are controlled and coordinated by a set of instructions computed and defined in the controller 130. In another embodiment, it is a diversion device to direct the eluted components of interest to a nuclear magnetic resonance (NMR) analysis. In another embodiment, it is a spotting device for the eluted components of interest to be spotted onto a matrix-assisted laser desorption and ionization (MALDI) plate.

In another embodiment illustrated in FIG. 1*c*, the apparatus 100 in accordance with the present invention for background subtraction-mediated data-dependent acquisition comprises both a DDA module 160*a* within the mass spectrometer 120 and a DDA module 160*b* outside of the mass spectrometer 120, along with all aforementioned connections between components. Both a data-dependent mass spectrometric acquisition function via 160*a*, e.g. a MS/MS acquisition, and a data-dependent sampling or other function via 160*b* are performed based on the current background-subtracted mass spectral information obtained in the background subtraction module 170.

Figure 2:
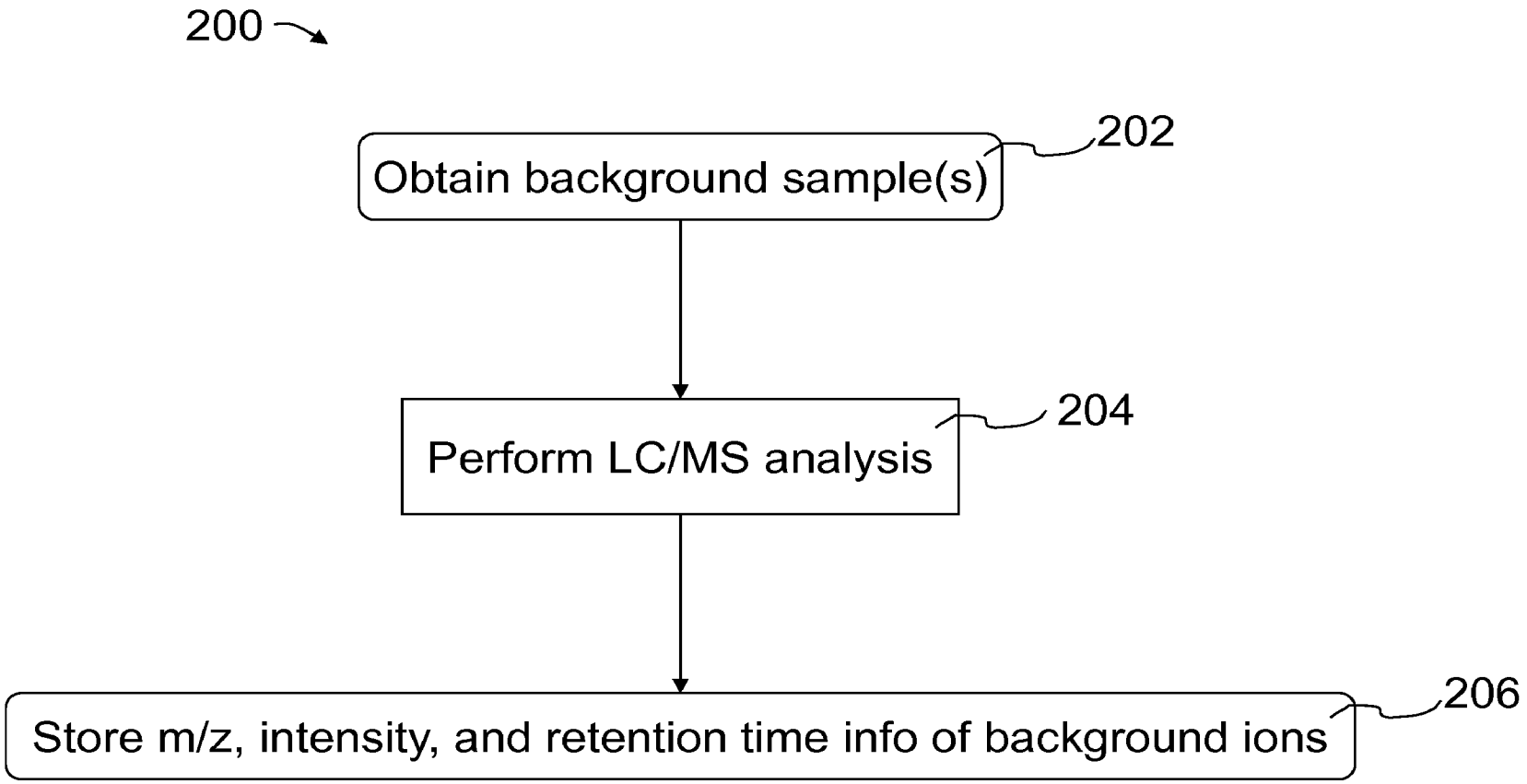
FIG. 2 is a flowchart illustrating the steps of a method of obtaining background data.

FIG. 2 sets out the steps of a preferred embodiment of obtaining the background data, referred to generally as 200, carried out preferably by the same apparatus 100 prior to the commencement of the analysis period of a background subtraction-mediated data-dependent acquisition. At step 202, one or a few background samples are obtained for a test sample to be analyzed with data-dependent acquisition. The background samples are expected to contain most, or virtually all, of the non-interesting components (e.g. sample matrix components) that are likely present in the test sample but contain none or significantly less amount of the components of interest. The background samples may or may not contain extra components that are not present in the test sample.

At step 204, the background samples are analyzed by the apparatus 100 to obtain a series of mass spectra along the chromatographic time scale of the analysis comprising m/z values and intensities of detected ions for the background components. The mass spectral data are preferably acquired in high resolution mode (e.g. mass resolving power>10,000 for mass range up to 3000 Da), and the measured exact mass m/z values of the same components in the datasets between runs are typically within a certain mass precision range (e.g., within 10 ppm). Such qualification criteria are routinely achievable with, e.g., time-of-flight (ToF) or Fourier transform (FT) type of instruments including Orbitrap™. In addition, the chromatographic elution time of a component between runs may shift and the shifts of different components may or may not be of the same length or in the same direction, but they are typically within a chromatographic fluctuation time range (e.g., less than 0.3 minute). It is important to keep the component-separation and mass spectrometry conditions identical or similar where applicable for the analysis of the background samples and the subsequent analysis of the test sample, so that ion signals between runs are comparable in the chromatographic time and m/z dimensions, and that a mass precision window and a chromatographic fluctuation time window are defined for obtaining background-subtracted MS spectra of the test sample in real-time, as will be discussed in greater detail below. In addition, it is important to keep the mass spectrometric acquisition function the same or equivalent where applicable for the acquisition of the background dataset and the acquisition of the precursor ion dataset of the test sample, so that non-interesting components in both datasets give similar ion populations for background subtraction to be effective. For example, in one embodiment, both datasets are obtained with regular MS acquisition functions without activating precursor ion fragmentation devices, and thus comprise mostly molecular ions of components. Alternatively, in another embodiment, both datasets are obtained with non-specific fragmentation acquisition functions with, e.g., in-source fragmentation or $MS^E$, and thus comprise mostly non-specific fragment ions of components.

At step 206, the acquired mass spectra and their associated chromatographic time information are stored typically to a background storage 180 as background data. In one embodiment, optionally, the background data are subject to additional processes to reduce the data set for faster access and computation purposes when being used for real-time background subtraction. For example, in one embodiment, they are subjected to processes of a noise and/or spike reduction algorithm. This can be done by simply removing any ions in a scan event (i.e., a scan at a chromatographic time point) whose equivalent m/z ions within a mass precision window does not exist in the data of the adjacent scan events immediately before and after it [US patent application 20100213368], or it can be done with other algorithms, e.g., the Windowed Mass Selection Method (Fleming, et al., *J. Chromatogr. A,* 1999, 849:71-85). For example, in another embodiment, a reduced form of the background data is obtained by extracting a subset of data representative of the original whole set of the background data and the reduced data set is used for background subtraction-mediated DDA. For example, spectra of background data of, e.g., every other scans is skipped without consideration. This is practical because in typical situations the sampling rate of a mass spectrometer is fast enough to allow the same matrix components being detected on multiple adjacent scans, and therefore the skip of every other scans or every two scans will not affect the ability to identify and subtract them. As will be understood, there are many ways to process and/or reduce the background data set without deviating from the scope of the invention, for example, converting the data to a different form (e.g. an array format) to represent the m/z, intensity, and retention time information of the background ions for faster access and computation purposes.

As an alternative to method 200, background data are prepared from other methods or resources. For example, historical/archival data and/or data from a chromatography/mass spectrometry system not exactly identical to apparatus 100 is used, as long as the retention time and m/z information of components in the data generally fall within the typical chromatographic time fluctuation window and mass precision window of their expected values if they were acquired with apparatus 100. Alternatively, background data is artificially synthesized for non-interesting components that are known to be present in the test sample data. For example, in one embodiment, the m/z value, retention time range, and intensity range of the components are assigned to the data array based on existing knowledge database or the literature. In one embodiment, the retention time range is a model peak's width (e.g. the width of a Gaussian peak). In another embodiment, it is the whole or a large portion of the chromatographic time duration of an intended analysis to define the component as a continuous background. In another embodiment, the intensity range is of a model peak's shape (e.g. a Gaussian peak shape) and/or specified with finite intensity values. In another embodiment, it is of infinitive value or specified in similar means to exclude the component from triggering any data-dependent acquisition. In some embodiments, background data from different resources are combined, for example, the acquired data of method 200 are combined with artificially synthesized data.

Figure 3:
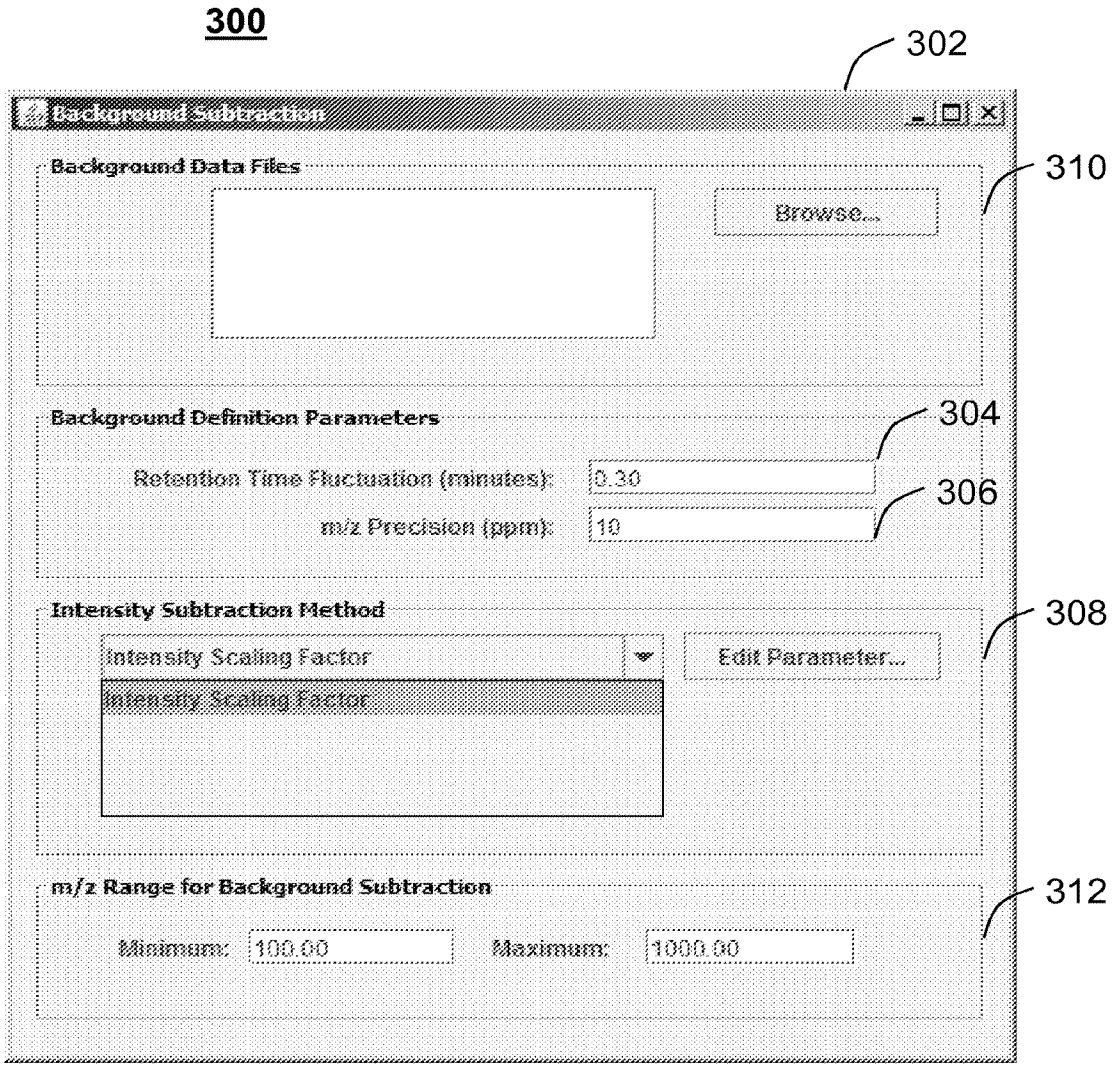
FIG. 3 depicts an exemplary screen shot of an I/O device of the system of FIGS. 1*a*-1*c*.

Referring now to FIG. 3, which illustrates an exemplary screenshot 300 of a computer screen 302 as was displayed on a display of the I/O device 140.

Figure 4:
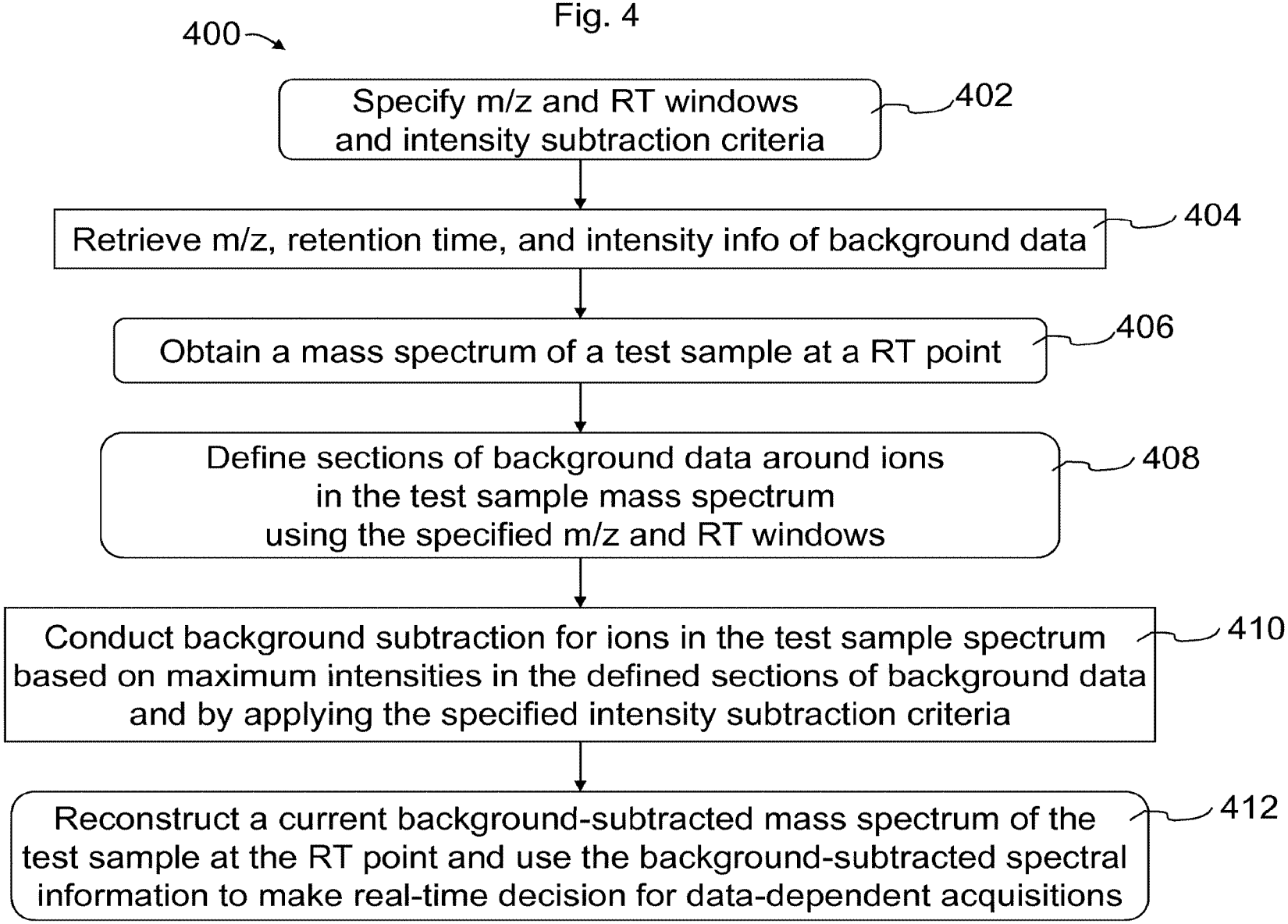
FIG. 4 is a flowchart illustrating the steps of a real-time background subtraction method for mediating data-dependent acquisition.

FIG. 4 sets out basic steps of an embodiment of a method for obtaining background-subtracted data in real-time to mediate data-dependent acquisition of a test sample, referred to generally as 400, carried out preferably by the apparatus 100 during an analysis period. It is understood that similar procedures of obtaining background-subtracted data via post-acquisition data processing, but not real-time background subtraction for mediating data dependent acquisition purpose, have been previously disclosed (e.g., Zhang, et al., *J. Mass Spectrom.* 2008, 43: 1181-1190; US 2010/0213368) and have been readily replicated in other labs (e.g., Zhu, et al., *Rapid Commun. Mass Spectrom.* 2009, 23:1563-72), which are hereby incorporated by reference in their entirety.

At step 402, typically before the analysis period of a test sample commences, the user determines a retention time fluctuation window, a m/z precision window, and an intensity subtraction method, and input them and their associated parameters to the background subtraction module 170 through the I/O device 140 (such as via fields 304, 306 and 308 illustrated on screen 302).

The retention time fluctuation window specified (i.e. the chromatographic fluctuation time window) is based on the range of chromatographic time fluctuations expected between runs of the chromatography/mass spectrometry system 100 and, in one embodiment, is set to a value accommodating typical diversity of chromatographic time fluctuations between runs, e.g., two times of the maximum known chromatographic time fluctuation. For example, if the chromatographic time fluctuation of components between runs is generally less than 0.3 min (measured by the apex peak time of the same components between runs), a chromatographic fluctuation time window of ±0.3 min is preferred, but other ranges are possible as will be understood. Typically it is not necessary to set the time window too wide (e.g. >100× the maximum known time fluctuation). If the time window is set too wide, it may increase the probability of erroneous subtraction of a component of interest in the test sample to adversely affect its data-dependent acquisition.

The m/z mass precision window specified is based on the range of mass measurement precisions expected of the chromatography/mass spectrometry system 100 and, in one embodiment, is set to a value accommodating typical mass measurement precisions between runs, e.g., two times of the maximum known mass measurement precision. For example, if the mass precision of components between runs is generally less than 10 ppm, the mass precision window is preferably set as ±10 ppm, but other ranges are possible as will be understood by a person of skill in the art. Typically it is not necessary to set the mass precision window too wide (e.g. >100× the maximum known mass measurement precision). If the mass precision window is set too wide, it may increase the probability of erroneous subtraction of a component of interest in the test sample to adversely affect its data-dependent acquisition.

In exemplary embodiments in accordance with the present invention, the intensity subtraction method is the application of an intensity scaling factor as illustrated in field 308 on screen 302. As will be described in greater detail below, when an intensity scaling factor is specified, the maximum intensity of ions in a defined section of the background data is to be multiplied by the specified intensity scaling factor before being subtracted from that of the ion in a test sample spectrum. Such scaling of the background ion intensities helps effective removal of background ions in typical cases where the amount of matrix components may differ between the test and background samples. In some embodiments, the intensity scaling factor is set based on the perception of the extent of the intensity (or amount) differences of sample matrix components or other non-interesting components between samples. In a preferred embodiment, the intensity scaling factor is set to be 2, but other values (e.g., 100) are possible as will be understood by a person of skill in the art. Typically it is not necessary to set the scaling factor too large (e.g., greater than 10000). If the intensity scaling factor is set too large, it may cause significant signal reduction for components of interest due to, e.g., trace amount of components of interest present in the background data and thus adversely affect their data-dependent acquisition.

In alternative embodiments, the intensity subtraction method is in other forms, e.g. an instruction to conduct intensity subtraction without scaling, to directly zero out an ion in the test sample MS spectrum solely based on the presence of equivalent ions in the defined section of the background data regardless of their intensity, or to contrast the intensity differences and represent them in ratio or percentile form, as will be described in greater details below.

At step 404, appropriate background data for the test sample analysis are specified, typically through the I/O device 140 (such as via filed 310 on screen 302). The system controller 130 may retrieve the specified background data, typically from background storage 180, and make them ready to be accessed by the background subtraction module 170. In a preferred embodiment, the specified background data are read into the memory of the controller before the commencement of the analysis period of the test sample, and the fed background ion information are arranged in a format that is suitable for fast computation purpose, e.g., in an array along the retention time and m/z dimensions. As will be understood, there are many alternatives to the preferred embodiment without deviating from the spirit of the invention. For example, in some embodiments, instead of the whole background dataset being fed before the commencement of the test sample analysis, portions of the background data are fed dynamically into a memory buffer of the controller in concurrence with the progression of the chromatographic time of the test sample analysis. In some embodiments, the fed background data are arranged in formats other than an array format but still suit the need for computing along the retention time and m/z dimensions. In some embodiments, additional processes of the background data similar to those mentioned for step 206 are applied here (if not conducted at step 206 already) to extract a reduced form of the background dataset or to eliminate random noises in the data.

At step 406, the user then typically inputs a command to commence an analysis period for a test sample (typically via the I/O device), upon receipt of which the controller 130 is programmed to initiate chromatographic separation of components in the sample and a first mass spectrometric acquisition function to record ions of components eluted along the chromatographic time scale. The eluting components from a separation module 110 are ionized in a mass spectrometer 120, and typically a series of mass spectra are obtained at small time intervals, ranging from, for example, 0.01-10 seconds, for the duration of the analysis period. Each mass spectrum of the first mass spectrometric acquisition function (which is sometimes referred to as the "precursor ion acquisition function") records the m/z values and intensities for all ions of components detected at each chromatographic time point of this function along the chromatographic time scale. As will be described in greater detail in the following steps below, typically once a scan event of the first mass spectrometric acquisition function is completed at a time point, the mass spectrometric data of this function is immediately processed with, e.g., a background subtraction algorithm and is evaluated in real-time to determine whether and how to proceed with a scan event of a second, data-dependent acquisition function. In addition to the second data-dependent acquisition function, additional acquisition functions is included in the analysis period. In some embodiments, scan events of the additional acquisition functions are interlaced with the scan events of the first mass spectrometric acquisition function. For example, in some embodiments, a non-specific fragmentation acquisition function (Zhang, et al., *Anal. Chem.,* 2009, 81:2695-700.) is included to record non-specific fragmentation spectra of the eluting components of the test sample. In one embodiment, a copy of the original mass spectral data of the first mass spectrometric acquisition function is to be saved in the data storage 150. In an alternative embodiment, the first mass spectrometric acquisition function is a survey scan function and therefore the obtained mass spectral data is only temporally stored in the memory of the controller 130 without being permanently saved.

Similar to the background data obtained via method 200, the mass spectral data of the first mass spectrometric acquisition function are preferably acquired in high resolution mode. In addition, the component-separation and mass spectrometry conditions used for acquiring the data are preferably identical or similar where applicable to the conditions used for acquiring the background data so that ion signals between runs are comparable in the chromatographic time and m/z dimensions, and that the mass precision window and chromatographic fluctuation time window specified at step 402 are meaningful for identifying ions of common components present in both the background data and the data of the first mass spectrometric acquisition function of the test sample.

At step 408, the background subtraction module 170 defines sections of the background data around ions in the obtained mass spectrum of the first mass spectrometric acquisition function of the test sample using the m/z and retention time windows specified at step 402. In some embodiments, the means for defining sections of the background data is carried out in similar manners to those described in US 2010/0213368. In exemplary embodiments, once the first mass spectrometric acquisition function has completed acquiring a mass spectrum of the test sample at a chromatographic time point, the background subtraction module applies the chromatographic fluctuation time window specified at step 402 around this chromatographic time point along the chromatographic time scale to define a section of the background data within the specified time window, e.g., relative and centered around this time point. Only background data within the defined boundaries of the chromatographic time dimension are considered for comparison with data in the mass spectrum of the test sample. In addition, the background subtraction module also applies the mass precision window specified at step 402 around each m/z value of ion signal of the mass spectrum of the test sample to define a section of ions of the background data whose exact mass m/z values fall within the specified mass precision window, e.g., relative and centered around the exact mass m/z value of the ion signal. Only ions of background data within the defined boundaries of the m/z dimension are considered to trigger the subtraction of the ion signal of that m/z value in the test sample mass spectrum. Ions in the background data whose exact mass m/z values fall outside of the defined m/z boundaries are excluded from consideration.

In some embodiments, as described in US 2010/0213368 and as will be understood by a person of skill in the art, the retention time window and the mass precision window are applied one-after-another or simultaneously, or in other fashions, to an array format of the background dataset in retention time and m/z dimensions, or the dataset in other suitable formats, to reduce computational redundancy and facilitate the speed of the process. The application of both the time and the mass windows specified at step 402 results in defined sections of background data within specified retention time and m/z boundaries for each m/z data point of the test sample spectrum, which, as will be understood, will allow common non-interesting components that also are present in the background data to be captured and thoroughly subtracted from the test sample spectrum regardless of their possible chromatographic time fluctuations within the specified chromatographic fluctuation time window, and at the same time will prevent unrelated isobaric components outside of the mass precision window from causing any erroneous subtraction of components of interest in the test sample spectrum.

In a preferred embodiment, the mass spectrum of the test sample is examined for background subtraction purpose for all m/z data points in the initial m/z range of the first mass spectrometric acquisition function. In an alternative embodiment, only m/z data points in the test sample mass spectrum whose m/z values are within a second m/z range are subjected to steps 408, 410, and 412 for background subtraction. This second m/z range is typically smaller than the initial m/z range and is within the initial range. For example, if the initial m/z range is 50-1500 Th, then the second m/z range is 150-1000 Th. (Th, or Thomson, is the unit of m/z values.) The second m/z range is typically determined based on perception of the m/z range of potential components of interest. The second m/z range of the first mass spectrometric acquisition function is input to the background subtraction module 170 typically through the I/O device 140 (such as via field 312 on screen 302) as part of step 402 before the analysis period commences.

At step 410, the method provides a means for conducting background subtraction for ion signals in the test sample spectrum based on examination and determination of maximum intensities of ion signals in their corresponding sections of background data (where the m/z and retention time boundaries in retention time and m/z dimensions were defined at step 408) and by applying the specified intensity subtraction method. The examination of defined sections of the background data and the subtraction of ion signals in the test sample spectrum are part of the functions of the background subtraction module 170. An ion signal in the test sample spectrum will be kept unchanged if this ion is not present within the defined section of the background data. If ion signals are present within a defined section of the background data, then the corresponding ion in the test sample spectrum is to be background-subtracted based on a specified intensity subtraction method.

In one exemplary embodiment, the specified method can first determine the maximum intensity of ions in the defined section of the background data set and then subtract this intensity from the intensity of the ion in the test sample spectrum. If the net value of the subtraction falls below zero, the intensity of the ion in the test sample spectrum is, for example, set to zero or the ion is annulled from the test sample spectrum.

According to a preferred embodiment, the maximum intensity of ion signals in a defined section of the background data is scaled with a specified scaling factor as illustrated at step 402 before being subtracted from that of the ion in the test sample spectrum.

According to an alternative embodiment, the method specified can directly zero out the intensity of an ion in the test sample data set solely based on the presence of ion signals within the corresponding defined section of the control sample data set without considering the intensity.

This method is applicable to certain situations where there is no sample carryover and the components of interest are not present in the control samples.

As will be understood by a person of skill in the art, there are many variations of an intensity subtraction method that can be designed and applied, and hence many variations of the means for subtracting ion signals in a test sample mass spectrum based on ion information in corresponding defined sections of background data, and they all are within the scope of the current invention.

At step 412, after completion of step 410 for all m/z data points within the initial m/z range or the second m/z range as specified of the first mass spectrometric acquisition function, the method records a list of current background-subtracted intensities of m/z data points of the test sample at the current chromatographic time point. This list of m/z and intensity information is referred to in this application as a "Current Background-subtracted Mass Spectrum" for the test sample at this time point, and the information is typically retained in the memory of the system controller 130 for making a real-time decision to mediate a subsequent data dependent acquisition scan event. Optionally, in some embodiments, a copy of the current background-subtracted spectrum along with its chromatographic time information is saved to data storage 150 as part of the permanent test sample dataset of the analysis. For ions whose signals are not present within the defined sections of the background data within the specified chromatographic fluctuation time and mass precision windows, their original intensities are recorded directly to the current background-subtracted spectrum along with their m/z values. In accordance with the exemplary embodiments of the invention, ions with intensity value of zero are recorded as such, or the m/z data points are redacted from the background-subtracted spectrum.

Figure 5A:
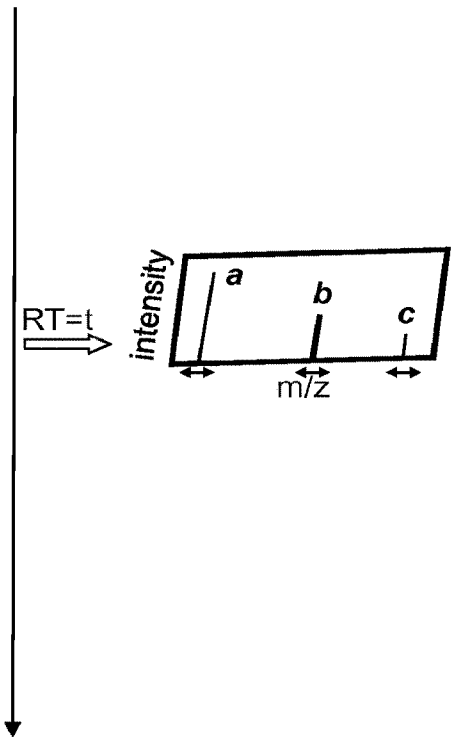
FIGS. 5*a*-5*c* illustrate the acquisition of a real-time background-subtracted spectrum for mediating data-dependent acquisition.
Figure 5B:
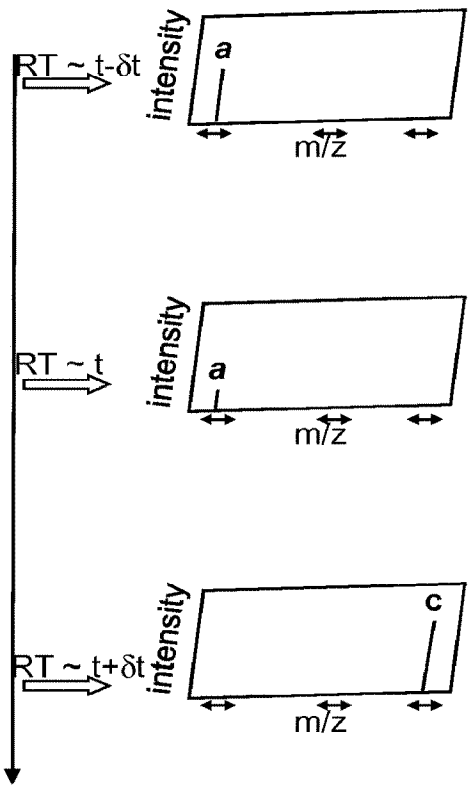
Figure 5C:
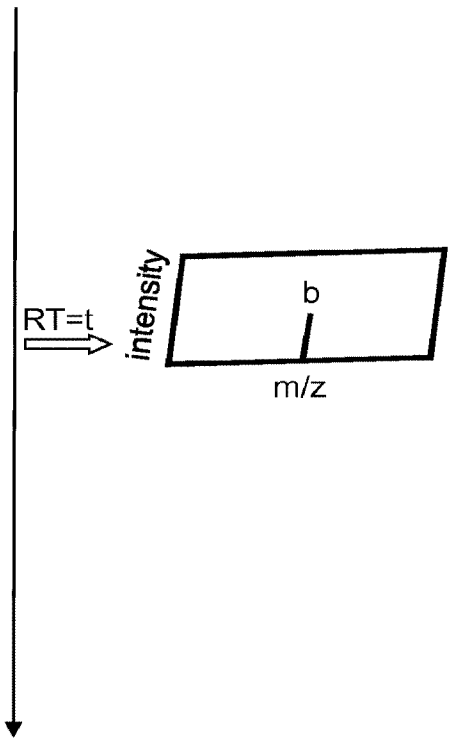

Illustrated in FIG. 5 is an example of obtaining a current background-subtracted mass spectrum of a test sample at a chromatographic time point. The long, vertical arrows illustrate the chromatographic time scale. The short, horizontal open arrows illustrate time points where the mass spectra are acquired. In each of the mass spectra illustrated, the ion intensities are plotted on the y-axis and the m/z values of the ion signals are plotted on the x-axis. FIG. 5*a* illustrates a current mass spectrum acquired from the first mass spectrometric acquisition function of the test sample at chromatographic time t. For purpose of explanation the spectrum in FIG. 5*a* contains only three m/z data points a, b, and c. FIG. 5*b* illustrates a section of background data that falls within a specified chromatographic time window δt around the chromatographic time point t, which for explanation purpose contains three background mass spectra at different chromatographic time points (e.g., ~t−δt, ~t, and ~t+δt) along the chromatographic time scale. The short, horizontal double arrows in FIG. 5*a* illustrate the width of the mass precision window being applied around ions in FIG. 5*a*. The same short, horizontal double arrows in FIG. 5*b* illustrate the corresponding m/z boundaries defined on the background data shown in FIG. 5*b*. By examining ion information in corresponding defined m/z boundaries, it is determined as annotated in FIG. 5*b* that ions a and c in FIG. 5*a* each have their equivalent ions in FIG. 5*b*, whereas ion b in FIG. 5*a* does not have a corresponding ion signal in FIG. 5*b*. The highest intensity of ion a in the background data is in the spectrum of RT~t−δt, and the highest intensity of ion c in the background data is in the spectrum of RT~t+δt. Assuming the intensity subtraction method is to apply an intensity scaling factor of 2 to the highest intensity of the background ions within the defined sections, then the highest intensity of background ion a at RT ~t−δt, and the highest intensity of background ion c at RT~t+δt are multiplied by 2 and are subtracted from intensities of ion a and ion c in FIG. 5*a*. Therefore, a background-subtracted spectrum of the test sample at chromatographic time t is illustrated in FIG. 5*c* showing only ion b because ions a and c are subtracted. The background-subtracted spectral information illustrated in FIG. 5*c* is to be used for decision-making of a subsequent data-dependent acquisition event. The subsequent DDA event now focuses on ion b, a potential component of interest in the test sample, instead of dealing with non-interesting components, i.e., ions a and c, in the original spectrum FIG. 5*a*.

The process time for conducting background subtraction of a mass spectrum depends on a number of factors including the power of the computation engine, the format of the background data input, the number of m/z data points in a spectrum, the chromatographic time and mass precision window settings, and the computation platform, language, and codes programmed to conduct the background subtraction-related operations. In an example with an average computation power and typical background subtraction parameters (e.g. 0.3 min chromatographic time window and 10 ppm mass precision window), the time to process a typical mass spectrum is a few milli-seconds or less, which is well suited for real-time decision-making of a subsequent data-dependent acquisition event. It is well understood that additional methods is used to further improve the process time without deviating from the scope of the invention. The methods may include but are not limited to: (1) dedicated background subtraction module with high computation power; (2) input background data into memory of the controller in array format or other means to allow fast access and computation; (3) pre-process the background data to reduce noise and data points; (4) improved computation and iteration coding, language, algorithm, etc.

According to other embodiments of the invention, the current background-subtracted spectrum is processed or combined with additional data processing techniques before being used for data-dependent acquisition decision-making purpose. For example, in some embodiments, the current background-subtracted spectrum is subjected to random noise reduction (e.g., by removal of any ions whose exact mass within a mass precision window do not appear in a previous scan), or mass defect filtering [U.S. Pat. No. 7,381,568B2, U.S. Pat. No. 7,589,318B2], or isotope pattern filtering [Zhu P, et al. Analytical Chemistry 2009, 81:5910-7], or a pre-defined mass-inclusion list before being used to mediate a data-dependent acquisition. Alternatively, the acquired mass spectrum of the test sample is first processed with additional data processing techniques, e.g. noise reduction and/or mass defect filtering and/or isotope pattern filtering and/or the filtering of a mass-inclusion list and then being processed to obtain the current background-subtracted spectrum. As will be understood, the combination of other data processing techniques with the real-time background subtraction method generally facilitates the detection of components of interest or the detection of a refined population of components of interest. In the rest of this application, "current background-subtracted spectrum" or "background-subtracted spectra" or similar terms imply that additional processes, e.g. noise reduction or mass defect filtering, or isotope pattern filtering, or the filtering of a mass-including list, may have been applied to the data.

Methods of performing a data-dependent acquisition in accordance with the present invention include a means that comprises the usage of the current background-subtracted spectral information obtained from a first mass spectrometric data acquisition function to mediate the events of at least one data-dependent acquisition function. As will be understood, the current background-subtracted spectra obtained are used in place of the original mass spectra of the first mass spectrometric data acquisition function to mediate scan events of a second data-dependent acquisition function in real-time. Therefore, the means of using current background-subtracted spectral information for mediating data-dependent acquisitions includes any existing or to-be-developed methods that use spectral information obtained from a first mass spectrometric data acquisition function in real-time to instruct the execution of a second data-dependent acquisition, some of the methods having been existing in commercial instrument software (e.g. XCalibur) and some having been disclosed in publications (e.g. U.S. Pat. Nos. 7,351,956 and 7,297,941), which are hereby incorporated by reference in their entirety. As will be further understood, the current background-subtracted spectral data are significantly different from the original un-subtracted spectral data in that signals of sample matrix and other non-interesting components are substantially removed. Therefore, the background-subtracted data enable some new and improved methods utilizing the background-subtracted spectral information, or characteristics and/or further derivatives of the information, to mediate data dependent data acquisitions. Data-dependent acquisition function, in accordance with the present invention, covers any function that deals with the chromatographic effluents of the test sample out of the separation module 110 in a timely fashion. It includes a mass spectrometric acquisition function; an acquisition function not related to mass spectrometry, e.g., a sampling or fractionation function.

Described below are a few embodiments of the means for using current background-subtracted spectral information to mediate data-dependent acquisition in accordance with the present invention for illustration purposes. It is understood that many variations and alternatives to the embodiments of the means is made by a person of ordinary skill in the art without deviating from the scope of the present invention.

Figure 6:
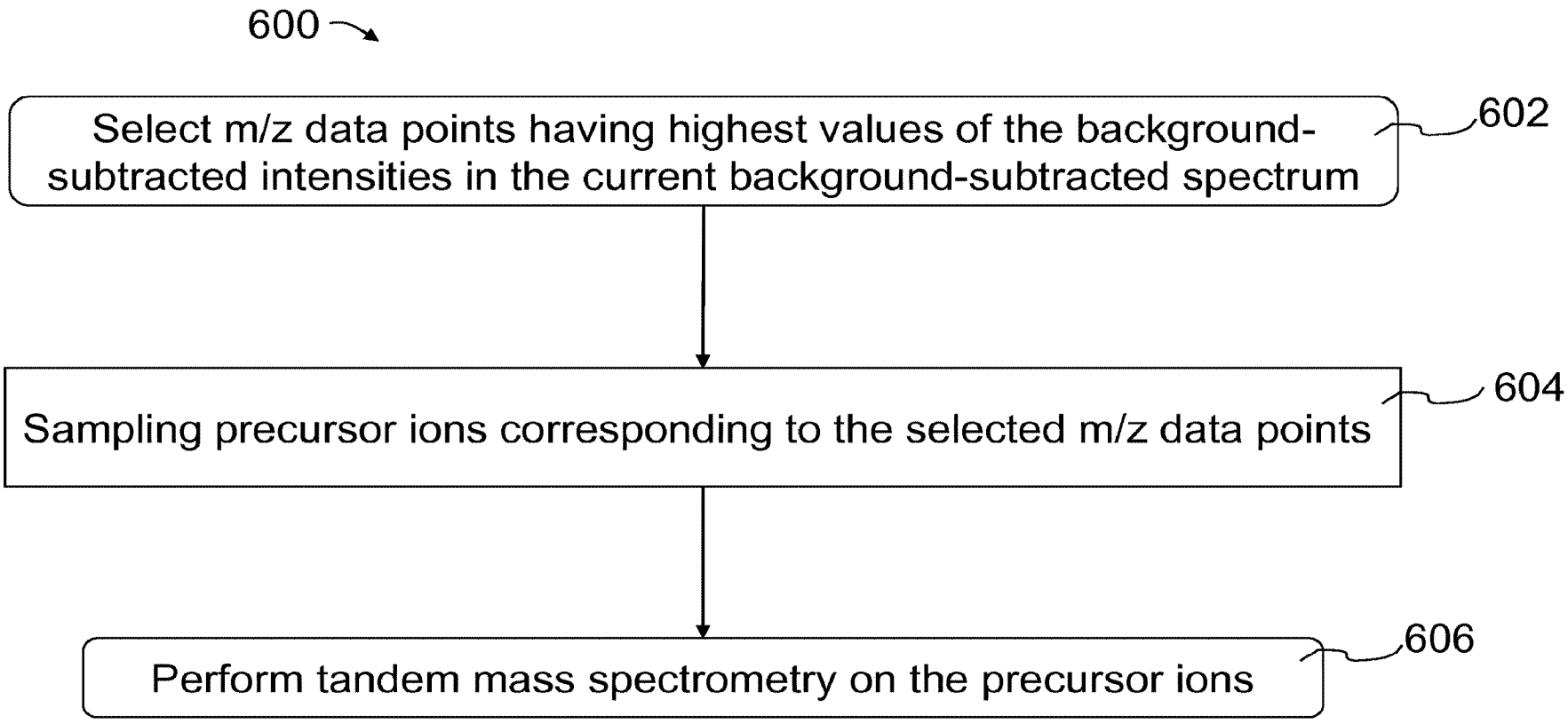
FIG. 6 is a flowchart illustrating the steps of a means of using current background-subtracted mass spectra to mediate data-dependent acquisition.

Illustrated in FIG. 6 is an embodiment of a means, referred to generally as 600, for performing a data-dependent MS/MS acquisition based on the most intense ion or several most intense ions present in a current background-subtracted spectrum. With appropriate background data that provide adequate coverage of non-interesting components in a test sample, signals of non-interesting components typically are removed from the current background-subtracted spectral data so that they cannot prevent components of interest from triggering data-dependent acquisitions. In addition, components of interest themselves are generally separated as discrete peaks in a typical good chromatographic separation. Therefore, decisions of data-dependent acquisition are made based on prominent ions in current background-subtracted spectra, which typically are relevant ions of components of interest in the test sample at current chromatographic time points. At step 602, immediately after step 412 of obtaining a current background-subtracted mass spectrum at a chromatographic time point, the controller 130 examines the current mass spectrum and selects one or a few m/z data points in the spectrum that have the highest value(s) of the background-subtracted intensities. At step 604, the controller 130 directs the DDA module 160*a* to sample one or a few precursor ion(s) corresponding to the selected m/z data point(s). At step 606, one or a few tandem mass spectrometric scan event(s) are performed on the precursor ion(s). In this embodiment an intensity threshold is typically not necessary for preventing data-dependent MS/MS acquisitions on ions whose intensities fall below the threshold, because often the most intense ion(s) in a current background-subtracted spectrum are either relevant ion(s) of the component of interest eluting at the chromatographic time point or there is no significant ion in the spectrum when there is no component of interest eluting at that time. Of course, if desired, one can still set an intensity threshold, but the threshold can typically be set very low at instrument noise level.

Figures 7A, 7B, 7C:
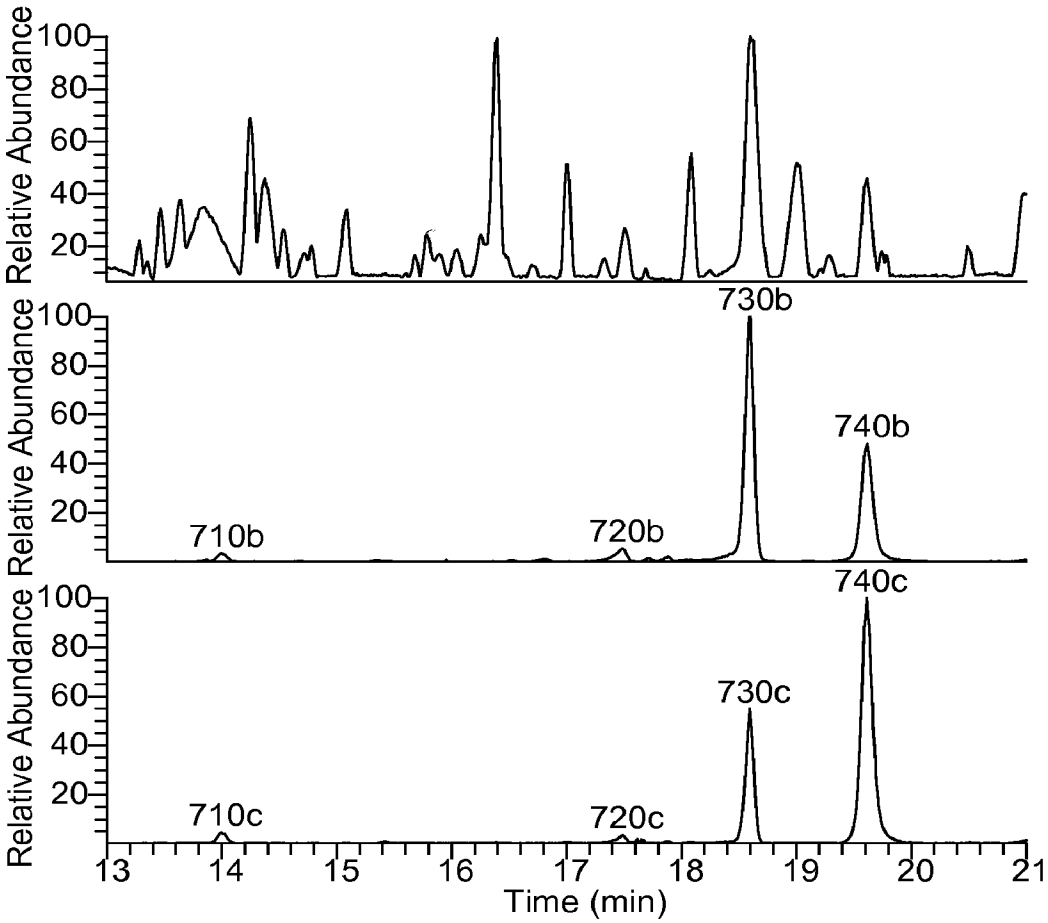
FIGS. 7*a*-7*c* illustrate the effect of method 600 in FIG. 6 with chromatograms.

In general, background subtraction-mediated data-dependent acquisition methods such as method 600 offers better chances for precursor ions of components of interest to be selected to trigger data-dependent MS/MS acquisition than methods without background subtraction. Therefore, the detection sensitivity of the data-dependent acquisition for components of interest is better, especially for minor components in a test sample. In addition, the embodiment illustrated in method 600 offers opportunity for data-dependent MS/MS data obtained for components of interest to display entire chromatographic peaks, instead of showing only partial peaks or one or a few discrete scan events. This advantage is illustrated in FIG. 7, where FIG. 7*a* illustrates a typical base peak ion (BPI) chromatogram representing the profile along the chromatographic time scale of the most intense ions in each of the original un-subtracted spectra from a first mass spectrometric acquisition function; FIG. 7*b* illustrates a typical BPI chromatogram representing the most intense ions in each of the current background-subtracted spectra from the first mass spectrometric acquisition function; and FIG. 7*c* illustrates a typical BPI chromatogram representing the most intense ions in each of the data-dependent MS/MS spectra acquired from a second mass spectrometric acquisition function. The data-dependent MS/MS spectra were acquired using method 600 by selecting the most intense ion in each of the current background-subtracted spectra of the first mass spectrometric acquisition function as the precursor ion for triggering each of the following MS/MS scan events. Since data in FIG. 7*c* were obtained in data-dependent fashion through the mediation of data in FIG. 7*b*, the data of components in FIG. 7*c* display entire peak chromatographic profiles for, e.g., peaks 710*c*, 720*c*, 730*c*, and 740*c* and the peak profiles resemble those presented in FIG. 7*b* (i.e., peaks 710*b*, 720*b*, 730*b*, and 740*b*). The availability of peak profile information with chromatographic continuity is valuable for researchers to interrogate, interpret, or quantify the data. For example, one can correlate the data-dependent MS/MS dataset with the precursor ion MS dataset using algorithms such as neutral loss filtering and product ion filtering to highlight particular components bearing fragmentation patterns of interest. In addition, chromatographic profiles of the data-dependent MS/MS dataset is correlated to and/or compared with UV-chromatogram, radio-chromatogram, or other profiles obtained from the sample analysis for further mining and/or correlation of the data. If using data in FIG. 7*a* to mediate data-dependent acquisition, however, competition from non-interesting components is high and the goal of most existing DDA methods (e.g. dynamic list exclusion or dynamic background exclusion) is to strive to get a chance to acquire a data-dependent MS/MS spectrum for components of interest if their intensity is competitive enough against co-eluting non-interesting components, and therefore the data-dependent MS/MS spectra for components of interest are often discrete in chromatographic scale and lack chromatographic comparability.

Another advantage illustrated in FIG. 7 is that the background subtraction-mediated data-dependent acquisition is performed on a smaller precursor ion dataset as illustrated in FIG. 7*b* and consequently the resultant MS/MS dataset is also smaller and yet more relevant to components of interest as illustrated in FIG. 7*c*. The smaller and yet more relevant MS/MS dataset allows easy review and interpretation for identifying components of interest. In contrast, if using un-subtracted data as illustrated in FIG. 7*a* to trigger data-dependent acquisition, firstly, most MS/MS data acquired would be related to intense ions of non-interesting components. Secondly, even if methods such as dynamic list exclusion and dynamic background exclusion are used to increase the opportunity of obtaining MS/MS data for lower intensity ions, more irrelevant MS/MS data will be generated, making it challenging to sift through the large dataset to identify information pertinent to components of interest.

Figure 8:
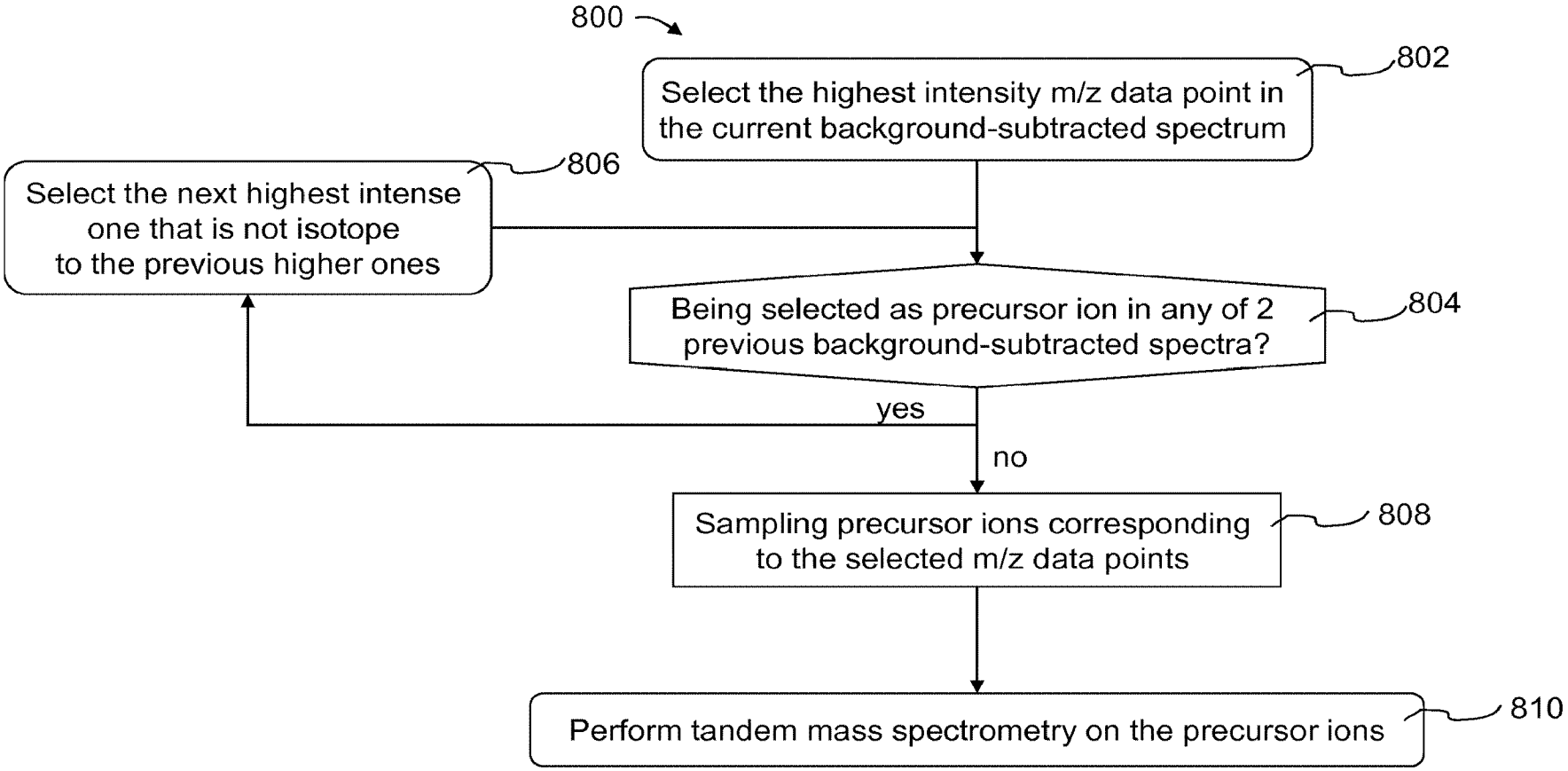
FIG. 8 is a flowchart illustrating the steps of another means of using current background-subtracted mass spectra to mediate data-dependent acquisition.

Illustrated in FIG. 8 is an embodiment of a means, referred to generally as 800, for performing a data-dependent MS/MS acquisition based on the intense ions present in a current background-subtracted spectrum along with a dynamic exclusion list. Typically, before the analysis period of a background subtraction-mediated DDA commences, a specific DDA method (e.g., method 800 as described here) is chosen as part of step 402 along with its associated parameters including those pertinent to an exclusion list. The specified method and parameters are typically input to the controller 130 through the I/O device 140. Immediately after step 412 of obtaining a current background-subtracted mass spectrum at a chromatographic time point, the controller 130 examines the current background-subtracted mass spectrum at step 802, and selects the m/z data point in the spectrum that has the highest value of the background-subtracted intensities. At step 804, the selected m/z data point is examined to determine if it has been selected as a precursor ion before in any of the previous set number of (e.g., two) background-subtracted spectra. If yes, the system controller skips this ion at step 806 and selects the next highest intense m/z data point in the background-subtracted spectrum that is not an isotope of the previous higher intensity ion(s). The parameters used for determining isotope ions are also set as part of step 402 and are input to the controller 130 through the I/O device 140. Step 806 is looped back to step 804 to determine if the ion has been selected as a precursor ion before in any of the previous set number of (i.e., two) background-subtracted spectra. The loop between step 806 and 804 repeats until the ion selected is determined at step 804 that it has not been selected as a precursor ion in previous set number of (e.g., 2) background-subtracted spectra. Then the process moves to step 808 where the controller 130 directs the DDA module 160*a* to sample a precursor ion corresponding to the m/z data point selected at 804. At step 810, a tandem mass spectrometry is performed on the sampled precursor ion.

By specifying, e.g., two previous scans to check whether an ion has been selected in them as a precursor ion, the embodiment illustrated in method 800 in effect used a dynamic exclusion list to exclude any selected precursor ion from being selected again in two subsequent scans in the first mass spectrometric acquisition function. As will be understood, other length of dynamic exclusion settings is set, e.g. one scan, three scans, or a specified length of time period for the first mass spectrometric acquisition function.

Figures 9A, 9B, 9C, 9D, 9E, 9F:
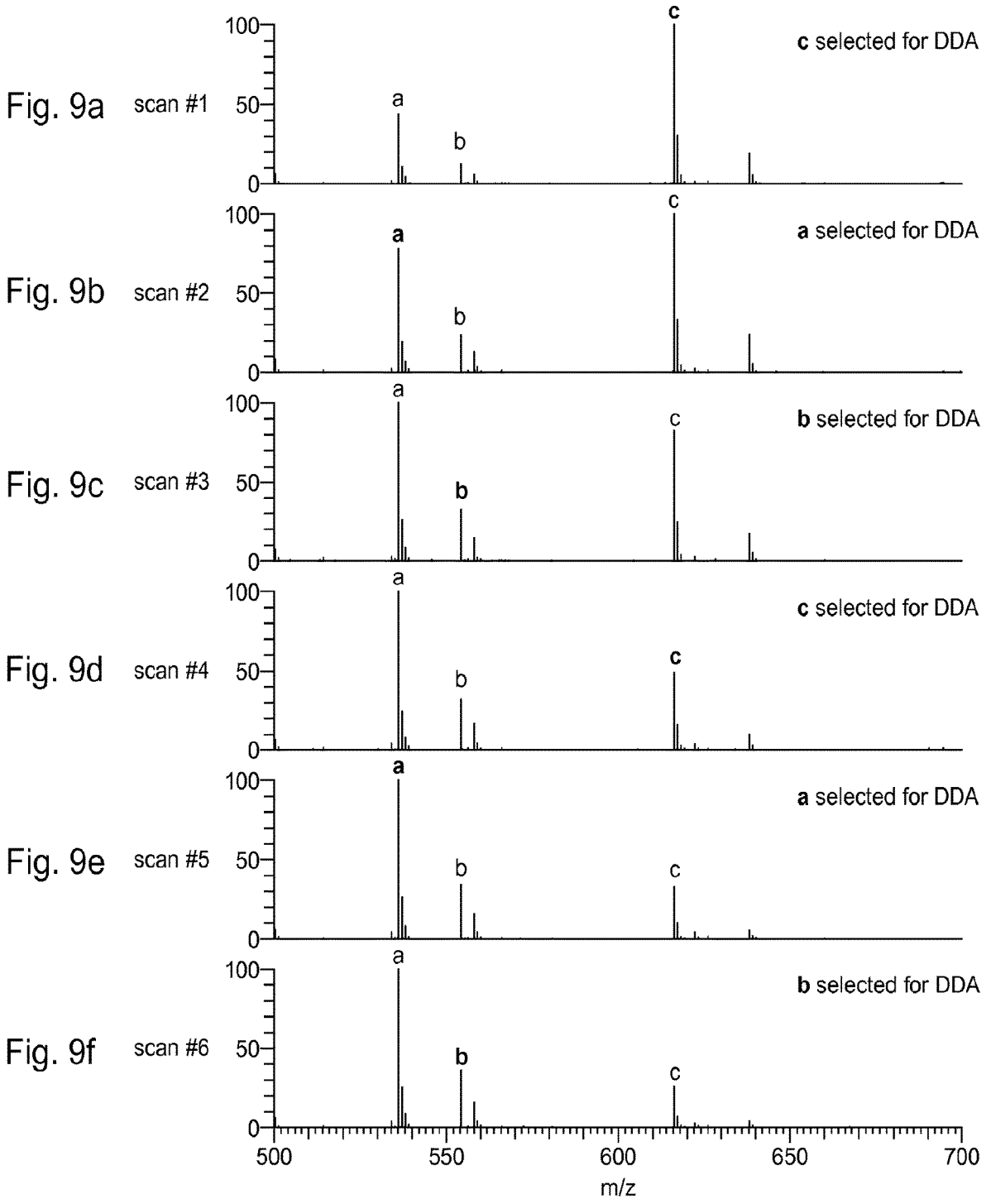
FIGS. 9*a*-9*f* illustrate decision points of using method 800 in FIG. 8 to mediate data-dependent MS/MS scan events.

With a dynamic exclusion list, the embodiment illustrated in method 800 allows data-dependent MS/MS scan events to be dynamically alternating between co-eluting ions in a chromatographic time region. The co-eluting ions are either from co-eluting components of interest or from the same components but in different ionic forms (e.g. adduct, doubly-charged, or in-source fragment). FIG. 9 illustrates decision points of using method 800 in FIG. 8 to dynamically select different ions of components of interest as precursor ions to trigger data-dependent MS/MS scan events. FIGS. 9*a*-9*f* illustrate six background-subtracted spectra from six consecutive scans (i.e. scan number=1~6) of a first mass spectrometric acquisition function. Assuming FIG. 9*a* is the first scan event of the first function, then ion c in FIG. 9*a* is the highest intensity ion not being selected in previous two scans. Therefore it is selected as the precursor ion for a subsequent DDA scan after scan number 1 of the first MS acquisition function. Ion c in FIG. 9*b* is excluded from selection because it was just selected in FIG. 9*a*, and therefore the next highest intense ion a is selected as the precursor ion for a subsequent DDA scan following scan number 2 of the first MS acquisition function. Likewise, ion b is selected as the precursor ion for FIG. 9*c* because the higher intense ions c and a are excluded. Similarly, ions c, a, b are selected as precursor ions from FIGS. 9*d*, 9*e*, and 9*f*, respectively, for data-dependent MS/MS scan events after each scan of the first MS acquisition function. In this example, ion b is an adduct of ion a, and ion c is a component different from the component of ion a. Both components are components of interest.

Because current background-subtracted spectra in accordance with present invention exclude most non-interesting components from consideration, they allow the precursor ion-selection process to focus on components of interest for data-dependent MS/MS acquisitions. For example, very few ions are depicted in spectra shown FIG. 9 because ion signals of sample matrix components and other non-interesting components have been subtracted from the spectra. Therefore, in general background subtraction-mediated DDA methods offer better sensitivity for minor components of interest. An intensity threshold (a term well known in the art) setting is typically not necessary for such data-dependent acquisition methods. If an intensity threshold is chosen to be included in a method, it typically is set to a relatively low value to take advantage of the better sensitivity that a background subtraction-mediated method offers.

The advantage of background subtraction-mediated methods on directing a data-dependent acquisition function on components of interest instead of non-interesting components also provides other benefits. For example, as illustrated in FIG. 9, a short exclusion period (e.g., 1-, 2-, or 3-scan events) is used to get data-dependent MS/MS data of co-eluting ions of components of interest. This advantage is even more prominent when a separation module is coupled with a high sampling rate mass spectrometer where the first mass spectrometric acquisition function (i.e., the precursor ion acquisition function) covers an eluting peak of component with, e.g., up to 20 scan events, allowing a data-dependent MS/MS function with sufficient scans (e.g., 5) per co-eluting ion to render some chromatographic characteristic for the obtained MS/MS data.

As will be understood by a person of skill in the art, there is many variations to the embodiment illustrated in method 800 for conducting data-dependent MS/MS acquisitions with a dynamic exclusion list without deviating from the scope of the invention. For example, in addition to the dynamic exclusion criteria applied at step 804, other criteria, e.g., noise/spike, can be used to exclude an ion from being selected. The noise/spike criteria are noise/spike checking steps, e.g. a step 807 (not shown in FIG. 8) that is used in addition to step 804. The noise/spike checking criteria are used to determine whether ion signal of the m/z data point of question in a current background-subtracted mass spectrum also appears in the previous, e.g., one or two scans within the specified mass precision window specified step 402, or they are set in other forms based on the random nature of the mass spectrometric instrument noise. For another example, when selecting the next highest intense ion at step 806, criteria are set so that the ion is neither an isotope of, nor one of specified ionic forms related to, the previous higher intensity ions. In some embodiments, the specified ionic forms are sodium or potassium adducts, or a different charge state, or a known in-source reaction (e.g., addition or loss of a water molecule). In some embodiments, the parameters used for determining related ionic forms for exclusion purpose at step 806 are set as part of step 402 and are input to the controller 130 through the I/O device 140. In addition, a dynamic exclusion list can be used in a variety of ways without deviating from the scope of the invention. For example, in some embodiments, instead of allowing a selected high intensity ion to perform only one DDA scan and immediately put it in the exclusion list, a specified number of scan events (either by length of time or by scan number) are set to allow the ion longer time of eligibility of being selected for data-dependent MS/MS acquisitions before it is put into an exclusion list.

In addition to the aforementioned embodiments of making DDA decisions based on either the most intense ion(s) in a spectrum or the most intense ions that are not in a dynamic exclusion list, other exemplary embodiments of means for using the current background-subtracted spectra to mediate DDA acquisitions are methods that identify ions of fast rising or otherwise distinctive mass signals in a precursor ion acquisition function, generally through comparison of a current background-subtracted mass spectrum against spectrographic backgrounds of one or more previously acquired and background-subtracted mass spectra. These methods can be carried out in similar manners to those described in, for example, U.S. Pat. Nos. 7,351,956, 7,297,941 or Kohli, et al., *Rapid Commun. Mass Spectrom.,* 2005, 19:589-596. For example, in one embodiment, the controller 130 accesses the background-subtracted spectral data and generates extracted ion chromatograms (XICs) for potential ions of interest based on the intensity of these ions over a number of scans. (An extracted ion chromatogram essentially represents the intensity profile of an ion signal of a specific m/z value along the chromatographic time scale.) In addition, the controller 130 may apply curve-fitting or other curve-approximating algorithms to provide curve approximations for all or any portions of an XIC generated. Then the controller 130 determines a first order and/or higher order derivative or other values associated with and/or characterizing a point of interest on the XIC. The first or other derivatives typically characterize whether the signal of a potential ion of interest is fast-rising, fast-decreasing, or approaching an apex or trough of a chromatographic peak with respect to time. Based on the derivative information obtained, the controller 130 makes real-time decision on whether to trigger a data-dependent acquisition of an ion and when to trigger it, and directs 160*a* and/or 160*b* to carry out the data-dependent acquisitions accordingly.

The previously existing methods of identifying ions of fast rising or otherwise distinctive mass signals typically optimize the timing for getting DDA data of an ion and thus creating an effect of dynamic background signal exclusion that allows more ions the chance of triggering data-dependent acquisitions. However, if not using current background-subtracted spectral data, these methods in themselves do not differentiate between components of interest and non-interesting components, and the competitions from ions of non-interesting components are typically high. Therefore, the previously existing methods have typically been used in combination with, e.g., intensity threshold, dynamic exclusion list, and other techniques to improve the efficiency of the DDA process. The use of current background-subtracted spectra significantly improves these methods in at least three aspects. First, it improves the process of identifying fast-arising or otherwise distinct mass signals, as those of most non-interesting components are already removed from the background-subtracted spectra and thus there are significantly fewer ions to deal with. Second, it simplifies the outcome of the data-dependent data acquired and thus improves the subsequent data review and interpretation. For example, in a data-dependent MS/MS experiment, the MS/MS spectra obtained are more selectively representing components of interest, resulting in typically smaller and yet more relevant dataset, instead of overwhelmed by data of non-interesting components. Third, since most sample matrix backgrounds are removed in the background-subtracted spectra, if one chooses to set an intensity threshold in a DDA method to prevent background noises from triggering DDA, a relatively lower intensity threshold is set without saturating the duty cycle, and thus improves the detection sensitivity for components of interest of relatively minor intensities.

In addition to improving methods of identifying ions of fast rising or otherwise distinctive mass signals, the availability of background-subtracted spectral data also enables DDA to be performed based on identifying fast rising or otherwise distinctive characteristics of base peak intensities of a precursor ion acquisition function. This is possible because of the fact that current background-subtracted spectra in accordance with present invention exclude most non-interesting components from consideration and thus typically allow ions of base peak intensities to be pertinent to components of interest, if present. The task of identifying fast rising or otherwise distinctive characteristics of base peak intensities is relatively simpler than the task of identifying ions having fast-rising or otherwise distinctive signals. This is because at each chromatographic time point although there are many ion signals, there is only one ion of base peak intensity to deal with. In some embodiments, the methods of identifying fast rising or otherwise distinctive characteristics of base peak intensities are carried out in manners similar to aforementioned methods described for identifying ions having fast-rising or otherwise distinctive signals, and are typically carried out through comparison of the base peak intensity of a current background-subtracted mass spectrum against base peak intensities of one or more previously acquired background-subtracted mass spectra. In some embodiments, the fast rising or otherwise distinctive characteristics are determined by subtracting the base peak intensity of a previous background-subtracted spectrum, or an average of base peak intensities of, e.g., previous 3 background-subtracted spectra, from the base peak intensity of the current background-subtracted spectrum. In alternative embodiments, the characteristics are determined by a percentage change of the base peak intensity in a current background-subtracted spectrum against the base peak intensity or an averaged of base peak intensities in one or more of the previously background-subtracted spectra. In some other embodiments, the characteristics are determined based on a base peak ion chromatogram generated from the background-subtracted spectral data over a number of previous precursor ion acquisition scans. The base peak ion chromatogram is further smoothed by applying curve-fitting or other curve approximation algorithm. First or other derivatives (with respect, for example, to time) at points of interest in time are determined, or approximated, to determine, e.g., whether to start or stop a data-dependent acquisition event and how to execute the acquisition event.

Figure 10:
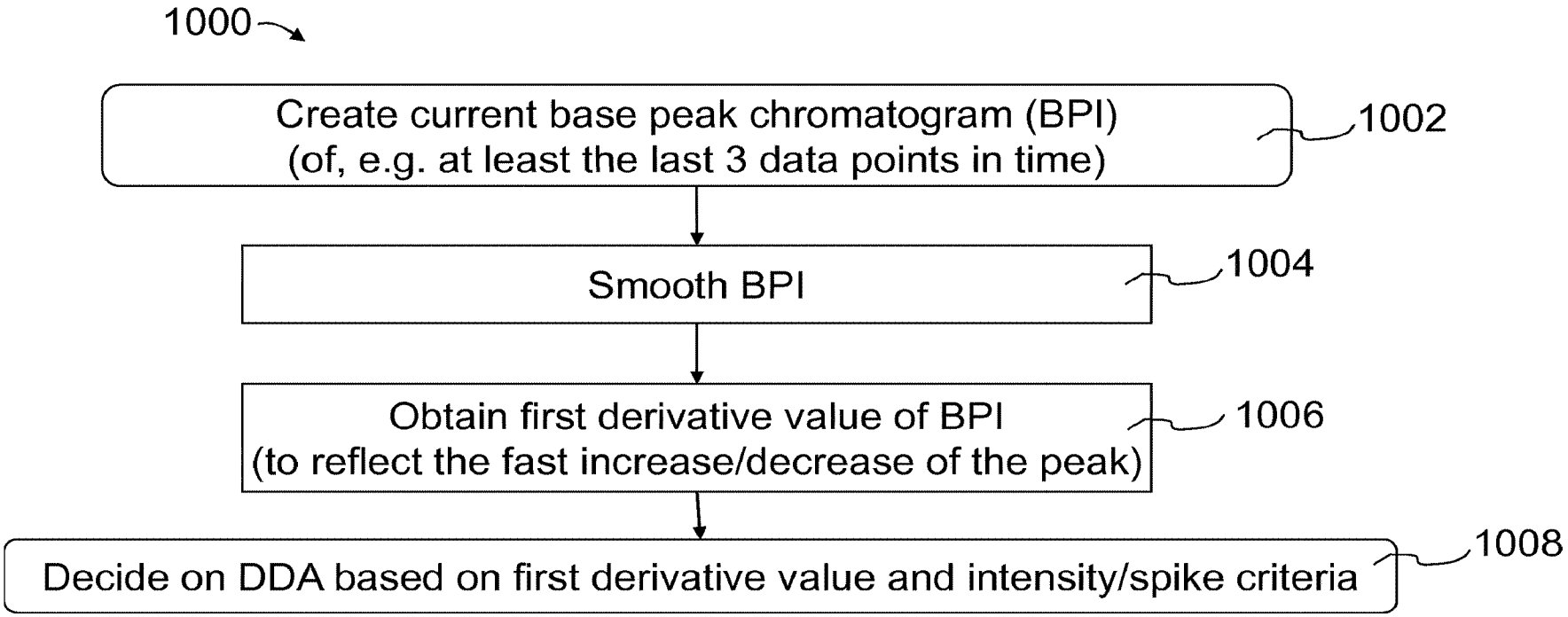
FIG. 10 is a flowchart illustrating the steps of a means of using chromatographic characteristics of current background-subtracted spectra to mediate data-dependent acquisition.

For illustration purpose, FIG. 10 sets out basic steps of an embodiment of a method, referred to generally as 1000, of performing data-dependent acquisition based on derivative values associated with real-time base peak ion chromatogram of the background-subtracted spectra obtained with method 400. At step 1002, after step 412 of obtaining a current background-subtracted mass spectrum at a chromatographic time point, the controller 130 accesses background-subtracted data of this scan and background-subtracted data of a selected number of previous scans from the first mass spectrometric acquisition function and generates a base peak ion chromatogram up to the current chromatographic time point. This can be accomplished in a wide variety of ways. For example, in some embodiments, as a first step a first-order curve approximated by line segments represented by straight lines drawn between individual base peak intensity data points along the chromatographic time scale is generated.

At step 1004, the controller 130 can perform any of a variety of curve-fitting algorithms to provide curve approximations for all or portions of the generated BPI chromatogram. Algorithms performed by the controller 130 include any suitable curve-fitting or smoothing algorithms or other suitable mathematical operations such as Gaussian model-fitting, including but not limited to various linear and non-linear curve-fitting methods, for example, least squares, weighted squares, and robust fitting (all with or without bounds); splines and interpolations, for example, polynomials of degree 2 or higher and exponential functions; and are used to determine a wide variety of derivative information concerning the base peak ion chromatogram, including but not limited to local or complete chromatogram curve approximations, rate of change at any one or more points on the curve (first derivative), local minimum and maximum points of the curve (zeros of the first derivative), and the area under the curve (integral).

At step 1006, the controller 130 can access data representing the smoothed BPI chromatographic curve and determine a first derivative or other value associated with and/or characterizing a point of interest on the BPI chromatogram. These first or higher order derivatives (with respect to time, for example) at various temporal or other points of interest in the analysis, based on smoothed or otherwise approximated BPI chromatographic curve, are determined in order to determine whether, for example, the base peak intensity is fast-rising, fast-decreasing, or approaching apex or trough of a peak or otherwise of interest for further analysis (e.g., U.S. Pat. Nos. 7,351,956, 7,297,941, or Kohli, et al., *Rapid Commun. Mass Spectrom.*, 2005, 19:589-596).

At step 1008, based on the derivative information obtained or the derivative information along with information from other data-processing techniques if used, the controller 130 makes real-time decision on whether to trigger (or to start and/or stop) data-dependent acquisition events and how to execute them, and directs 160*a* and/or 160*b* accordingly. As understood by a person of skill in the art, a DDA event can be a period covering a region of a base peak ion chromatogram (e.g. a peak) associated with a start and a stop of the event; or it can be an event at a single chromatographic time point; or an event of a period in which there are further events at time points. For example, in some embodiments, an event of a period comprises start and stop of fractionation for a peak in a BPI chromatogram; or during an event of start-and-stop period (e.g. covering a peak region) multiple data-dependent MS/MS acquisition events are triggered. A variety of ways can be used to set the decision-making criteria based on the purpose of an analysis. Generally, the decision-making criteria are set based on user inputs through the I/O device 140 before the commencement of the analysis period and/or are set real-time based on automatic statistical evaluation of the data. In one embodiment, a derivative value of a rate of fast-rising triggers a start of a DDA event of a period and a derivative value of a rate of fast-decreasing triggers a stop of the DDA event of a period on 160*b* and/or 160*a*. In another embodiment, a derivative value characterizing the base peak intensity approaching apex of a peak triggers a DDA event on 160*a* and/or 160*b*. In an embodiment of a DDA event of a period for MS/MS tasks with 160*a*, the m/z values corresponding to the base peak intensities within the event period are selected as precursor ions to further trigger MS/MS events. In another embodiment of a DDA event of a period for MS/MS tasks with 160*a*, one or a few additional methods, e.g., dynamic exclusion list, are applied to allow not only the base peak ions but also ions other than the base peak ions to be selected to trigger MS/MS events. In an embodiment of a DDA sampling task with 160*b*, derivative values characterizing the valley or trough between peaks may direct 160*b* to change wells or spots for chromatographic effluent fractionation. In yet an alternative embodiment, the DDA decision-making is based on both the derivative value at a BPI chromatographic point and a threshold setting of the base peak intensity. For example, derivatives of fast-rising or apex-approaching values may not trigger the start of a DDA event if the base peak of the current background-subtracted spectrum is below the intensity threshold, or the period of a DDA event may stop when the base peak intensity falls below the intensity threshold before the derivative reaches a targeted fast-decreasing or trough value.

In addition to intensity threshold, in some embodiments, other data-processing techniques are combined with methods of identifying fast rising or otherwise distinctive characteristics of base peak intensities, including but not limited to noise/spike exclusion, dynamic exclusion list, mass defect filtering, isotope pattern filtering, methods of identifying ions of fast rising or otherwise distinctive mass signals, or other techniques or processes to refine or improve the DDA decision-making.

In addition to base peak intensities and/or base peak ion chromatogram as illustrated in method 1000, other types of intensities and chromatograms, including but not limited to total ion intensities and/or total ion chromatogram, is used, in accordance with current invention, to determine characteristic derivative values of these intensities and/or chromatogram with respect to time. In the case of total ion chromatogram, for example, the system controller can determine total ion intensities of the background-subtracted spectra of a first mass spectrometric acquisition function and generate a total ion chromatogram along the chromatographic time scale up to a current chromatographic time point at 1002.

It is well understood that the means for using the background-subtracted spectral information to mediate a data-dependent acquisition may take a variety of forms, for example, individually or in combination with other process or algorithms pertinent to DDA decision-making, including but not limited to mass defect filtering, isotope pattern filtering, neutral loss filtering, or a pre-defined mass inclusion list. It is well understood that there are many ways of combining the various means and methods and they are all within the scope of this invention as long as some of the instructions of a DDA function are computed and defined based on the current background-subtracted mass spectral information. For example, in some of the combination forms more than one means is allowed to trigger DDA events whereas in some other forms a user-defined priority order is specified so that one means may have priority over the other.

Regardless of the means chosen for using the background-subtracted spectral information to mediate a data-dependent acquisition, whether it being based on one or a few of the most intense ion(s) present in a current background-subtracted spectrum, or based on the most intense ions that are not in a dynamic exclusion list, or based on identification of ions of fast rising or otherwise distinctive mass signals, or based on identification of fast rising or otherwise distinctive characteristics of base peak intensities or total ion intensities, or other means of using the background-subtracted spectral information, or a combination of the means, or a further combination with data-processing techniques such as intensity threshold, noise/spike reduction, mass defect filtering, and/or isotope pattern filtering, an advantage that is common to embodiments of aforementioned means is that signals of non-interesting components are subtracted from data of the first mass spectrometric acquisition function and therefore the subsequent DDA scan events are carried out selectively on ions or peaks that are pertinent to components of interest.

Another advantage that is characteristic to the background subtraction-mediated DDA methods in accordance with the current invention is that the background data used for conducting real-time background subtraction are obtained typically prior to the commencement of the analysis period of a test sample, and therefore flexibility exists to design and construct background samples specifically for a test sample or to construct and/or modulate the background datasets per user's desire to maximize the advantage of selectively and/or effectively detecting a particular set of components of interest in data-dependent acquisitions. In some embodiments, the background and test samples are constructed based on stable isotope labeling techniques via chemical tagging (e.g., ICAT, iTRAQTM, or TMT1) or metabolic incorporation (e.g., SILAC, stable-labeled glutathione) or other means so that after background subtraction only peaks associated with the difference of the stable isotope labeling between the test and background samples remain in the test sample data of a first mass spectrometric acquisition function, allowing selective data-dependent acquisitions on these peaks. In some other exemplary embodiments, more than one background sample and/or more than one background dataset is used to expand the population of non-interesting components to be removed, thus facilitating selective detection of a restricted population or type of potential components of interest.

For example, illustrated in FIG. 11 is an application in accordance with the embodiments of the present invention using two sets of background data to enable the DDA to selectively detect and/or fractionate components of particular interest in a sample. Suppose the components of particular interest are glutathione-trapped metabolites in a drug metabolite sample obtained through liver microsomal incubation of the drug with glutathione. Two sets of background data are obtained before the analysis of the drug metabolite sample to provide coverage of all possible non-interesting components in the sample matrix. For example, FIG. 11*b* illustrates a base peak ion chromatogram of a set of background data representing mostly liver microsomal components and glutathione-related components without any drug-related components. FIG. 11*c* illustrates a base peak ion chromatogram of a second set of background data representing mostly liver microsomal components and drug-related components (e.g. the drug and its metabolites) but without any glutathione-related components. FIG. 11*a* illustrates a portion of the base peak ion chromatogram of the original un-subtracted data of the drug metabolite sample generated from the progression of the first mass spectrometric acquisition function up to the time point of 15 min. The drug metabolite sample shown in FIG. 11*a* is expected to contain liver microsomal components, drug-related components, and glutathione-related components. It may also contain potential components of interest, i.e., glutathione-trapped metabolites of the drug if any. However, the potential glutathione-trapped metabolite of the drug would be of minor intensities and typically would be buried under base line of ion signals of various non-interesting components in the sample in the original un-subtracted data. Real-time background subtraction is conducted on data in FIG. 11*a* using both sets of background data illustrated in FIG. 11*b* and FIG. 11*c* to purposely remove all major non-interesting components including some of the drug metabolite peaks shown in FIG. 11*c*. The results are depicted in FIG. 11*d*, which illustrates a portion of the base peak ion chromatogram up to the time point of 15 min. A few glutathione-trapped metabolites of interest, although only 0.5% or less in the y-axis scale, are highlighted as well-defined peaks (peaks 1110, 1120, and 1130) in the background-subtracted base peak chromatogram. Thus the thoughtful use of complementary background datasets allows for tailored removal of non-interesting components, enabling the subsequent DDA to be conducted on a particular subset of components of interest present in the background-subtracted data.

The example shown in FIG. 11 also illustrates the flexibility of the background-subtracted data for triggering multiple types of data-dependent acquisitions. For example, derivative values characterizing the real-time background-subtracted base peak chromatogram (illustrated in FIG. 11*d*) is used alone or is used in combination with an intensity threshold (illustrated as block 1100 in FIG. 11*d*) to trigger the start and stop of DDA events of periods for peaks 1110, 1120, and 1130. In one embodiment, the data-dependent acquisition for each event of period is a data-dependent MS/MS acquisition event on 160*a*. In another embodiment, it is a data-dependent sampling or fractionation event on 160*b*. Or, in some embodiments, it includes multiple types of data-dependent acquisitions, for example, with DDA MS/MS acquisition events on 160*a* and a DDA sampling event on 160*b*. In some embodiments, the DDA sampling event is for fractionation on a microplate, to a MALDI plate, or to NMR tubes, or the like.

Figure 11A:
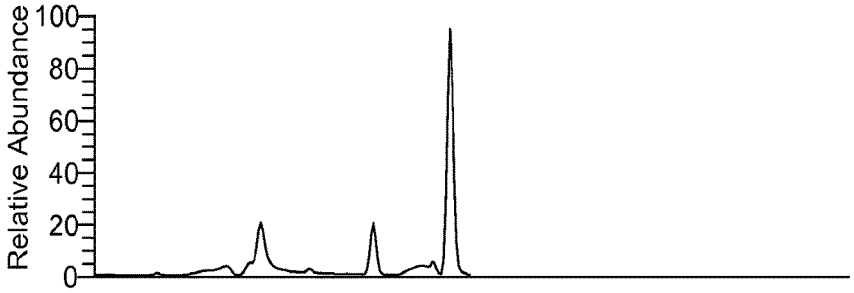
FIGS. 11*a*-11*d* illustrate tailoring background data according to a user's need to mediate DDA selectively on a particular subset of components of interest.
Figure 11B:
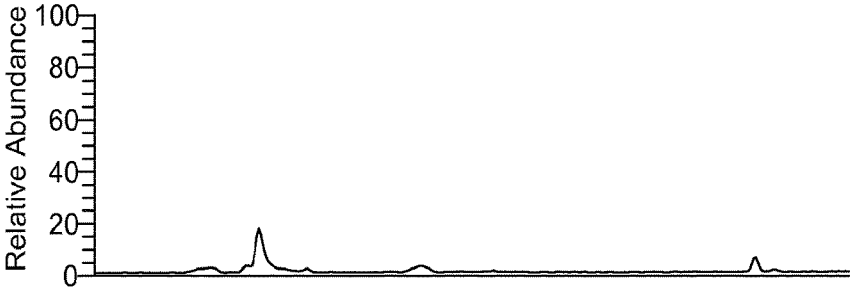
Figure 11C:
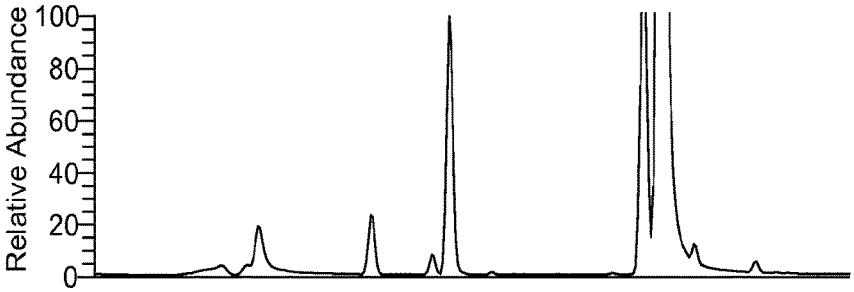
Figure 11D:
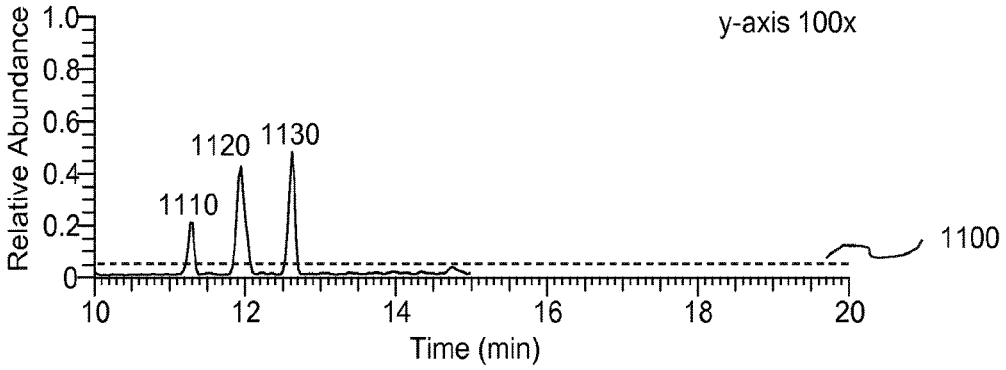

Another advantage illustrated in FIG. 11 is that the background subtraction-mediated data-dependent acquisition is performed on a smaller precursor ion dataset as illustrated in FIG. 11*d* and consequently the resultant MS/MS dataset if acquired would be much smaller and yet more relevant to the components of interest (i.e., glutathione-trapped drug metabolites) if compared against DDA MS/MS data if obtained using data illustrated in FIG. 11*a* as the precursor ion dataset. The smaller and yet more relevant MS/MS dataset allows easy review and interpretation for identification of the glutathione-trapped drug metabolites, alleviating the need of sifting through large amount of MS/MS data mostly related to non-interesting components in the sample.

Although a few types of component-of-interest entities and application examples are mentioned herein for illustration purpose, it is well understood that background subtraction-mediated data-dependent acquisition in accordance with current invention is suitable for a wide variety of different types of chemical entities and is for a wide range of application purposes including but not limited to sports sample testing, horse racing sample testing, impurity of pharmaceuticals, metabolites, peptides, lipids, sugars, pesticides, biomarkers, drug-of-abuse, environmental analysis, biomedical analysis, clinical testing, food testing, forensic analysis, etc. It not only enables selective data-dependent mass spectrometric characterization of potential components of interest, but also enables intelligent fractionation and/or other means of analysis for potential components of interest, and suits for, e.g., archival, confirmation and/or follow-up characterization purposes.

In some embodiments, the aforementioned first mass spectrometric acquisition function is to obtain mainly molecular ions of components; in some other embodiments, the aforementioned first mass spectrometric acquisition function is to obtain mainly fragment ions of components. The latter embodiments are achieved through, e.g., non-specific fragmentation techniques including source CID, $MS^E$, or similar techniques. In either cases, current background-subtracted spectral information of the first mass spectrometric acquisition function is obtained and is used to mediate data-dependent acquisition function(s). In an alternative embodiment, two precursor ion acquisition functions is included, with one for obtaining mainly molecular ions of components and another for obtaining mainly fragment ions of components through, e.g. non-specific fragmentation techniques, or with one for obtaining positive ion signals of components and another for obtaining negative ion signals of components through, e.g. polarity-switching techniques. Background-subtracted spectral data of both precursor ion acquisition functions are obtained and are used to mediate data-dependent acquisitions in real-time. This alternative embodiment allows, for example, a data-dependent MS/MS acquisition function to obtain MS/MS data for molecular ions of components of interest and another data-dependent MS/MS acquisition function to obtain MS/MS data for major fragment ions of components of interest. In other cases, this alternative embodiment allows for a data-dependent MS/MS acquisition function to obtain positive ion MS/MS data for components of interest and another data-dependent MS/MS acquisition function to obtain negative ion MS/MS data for components of interest. The rich MS/MS data obtained would benefit structural elucidation for components of interest.

In other embodiments, the intensity subtraction method applied at step 410 and hence the means for subtracting ion signals involve contrasting the intensity difference between an ion signal in a current test sample spectrum and the maximum intensity in corresponding defined section of the background data, or contrasting the intensity difference between an ion signal in a current test sample spectrum and the maximum intensity in corresponding defined section of the background data with the maximum intensity being multiplied by a specified scale factor. The outcome of the contrasting is expressed in percentile, ratio, or other forms, being either intensity in test sample vs. intensity in background or vice versa. Hence the current background-subtracted spectrum at step 412 refers to a list of current intensity ratios or other values (relative to background) of m/z data points of the test sample at the current chromatographic time point. The current background-subtracted spectral information is used to make a real-time decision for a data-dependent acquisition. A means is supplied to address situations where the denominator (e.g. the background intensity) is of zero value. One embodiment of the means is to create a sub-list registering the intensity values of m/z data points of the test sample who have zero intensity values in corresponding background data. Data points in this sub-list take priority over the rest data points that are expressed as ratio or percentile when triggering data-dependent acquisition. For example, when method 600 is applied to data-dependent acquisition, the highest intensity ions in the sub-list of a current background-subtracted mass spectrum are selected first to perform the subsequent MS/MS scan events; only when no ions exist in the sub-list would ions of highest intensity ratio values be selected for the subsequent MS/MS scan events. In addition, a dynamic exclusion list (as illustrated in method 800) can be applied to prevent the same high-ranking ions (being either in the sub-list or not) from continuously being selected for data-dependent acquisitions.

In other embodiments, the retention time and/or mass precision windows specified around individual m/z data points of a test sample spectrum to define sections of background data at step 408 are applied in an asymmetric way concerning the positions of the retention time and m/z boundaries relative to the position of a m/z data point. For example, the retention time and/or m/z boundaries on one side of the test sample m/z data points are closer to (or farther away from) the position of the m/z data point than on the other side along the respective chromatographic time and/or m/z scales. For example, peak tailing factor is factored in when applying a retention time window.

In other embodiments, a variable chromatographic fluctuation time window is specified at step 404 such that the time window for defining a range of background data is wider (or narrower) for a current test sample spectrum depending on the current chromatographic time value (and/or the m/z value and/or its intensity and/or other properties of a test sample data point) than at a different time value (and/or the m/z value and/or its intensity and/or other properties of a data point). Similarly, in some embodiments, a variable mass precision time window is specified at step 404 such that the mass precision window for defining a range of background data is more restrictive (or more tolerant) for the m/z value of a test sample data point depending on the current chromatographic time value (and/or the m/z value and/or its intensity and/or other properties of the test sample data point) than at a different time value (and/or the m/z value and/or its intensity and/or other properties of the test sample data point). In these cases, the chromatographic time and/or m/z boundaries for defining sections of the background data are viewed as a series of scalable sections along the chromatographic time and/or m/z scales based on information of respective ions in question in the test sample spectrum.

Methods of background subtraction-mediated data-dependent acquisition in accordance with current invention can be used for analysis of individual test samples, and can also be used for analyzing multiple test samples in batch mode. A batch mode can be implemented through, e.g., a list of sample sequence. In some embodiments, background dataset(s) are assigned to individual test sample in the list for real-time background subtraction purpose, or common background dataset(s) are assigned to multiple or all of the test samples in the list.

EXAMPLES

For illustration purpose, some non-limiting examples of background subtraction-mediated data-dependent acquisition are given below to help comprehension of the present invention. Referenced in the examples are some of the means for data-dependent acquisition, which have been elaborated in other sections.

Example 1

To detect and characterize glutathione-trapped metabolites of a drug presented in a microsomal incubation sample (the test sample), two control samples were obtained for the test sample: a microsomal incubation sample of the trapping agent glutathione without the drug, and a mirosomal incubation sample of the drug without glutathione. (see Zhang, et al., *J. Mass Spectrom.* 2008, 43: 1181-1190, which is hereby incorporated by reference.)

A mass spectrometric scan function was set for the two control samples using an LC/MS system with a mass resolution of Rs100,000 to obtain high resolution LC/MS data of these samples. A precursor ion scan function was set for the test sample. The LC and the precursor ion scan function conditions were set the same as those used for the two control samples. The method and parameters for real-time background subtraction processing of spectra from the precursor ion scan function were set for the test sample. The maximum-intensity-subtraction algorithm was used for the background subtraction operation. Data to be acquired of the above two control samples were specified as background data. Other background subtraction parameters: chromatographic fluctuation time window: 0.3 minute; mass precision window: 10 ppm; background data intensity scale factor: 2×.

A data-dependent MS/MS acquisition function was set for the test sample, which follows Method 600 (to be elaborated later), dictating that the m/z value of the highest intensity ion signal in a current background-subtracted mass spectrum of the precursor ion acquisition function would be selected and activated to obtain its MS/MS spectrum in a subsequent data-dependent scan event.

The LC/MS analysis was initiated, first on the two control samples and then on the test sample, with the injection volume of 15 microL for each sample. The data acquired for the two control samples were the background data. Depicted in FIGS. 11*b* & *c* are the base peak ion chromatograms of the data of the samples, respectively. Mass spectra from the precursor ion acquisition function of the test sample were acquired and recorded. Depicted in FIG. 11*a* is the real-time base peak ion chromatogram of the data up to a current time point of 15 min.

Mass spectra from the precursor ion acquisition function of the test sample, while being acquired, were each subjected to background subtraction processing with aforementioned Method 400 in real time. Briefly, using the spectrum at the current chromatographic time point (15-min) as an example, for each ion in the spectrum, its equivalent ions in the background spectra of the two control samples from RT14.7 to RT15.3 minutes, i.e. ±0.3-min around 15-minute, were defined (m/z values in the spectrum vs. the background data were matched as long as they fell within the specified mass precision tolerance window around that of the ion, which was set to ±10 ppm); The maximum intensity of the equivalent ions in the defined section of the background data was then determined and multiplied with the scaling factor (2×) and was subtracted from that of the ion in the spectrum at 15-min. The resultant current background-subtracted spectrum at 15-min was recorded and became part of the background-subtracted spectral dataset. Depicted in FIG. 11*d* is the real-time base peak ion chromatogram of the background-subtracted spectral data of the precursor ion acquisition function up to the current time point of 15 min. Note that ion signals of a few glutathione-trapped drug metabolites now become prominent in FIG. 11*d* (intensity less than 1% of the scale of FIG. 11*a*).

After each scan event of the precursor ion acquisition, m/z value of the highest intensity ion signal in the current background-subtracted mass spectrum was selected and activated to obtain its MS/MS spectrum in a subsequent data-dependent scan event. As a result, MS/MS spectra of the doubly-charged molecular ions of the few glutathione-trapped drug metabolites, which were the base peak ions in the regions highlighted in FIG. 11*d* (1110, 1120, 1130), were obtained.

Example 2

This is a variation of Example 1. The only difference is that the data-dependent MS/MS acquisition function was set following aforementioned Method 800, dictating that the m/z values of high intensity ion signals in a current background-subtracted mass spectrum of the precursor ion acquisition function would be checked against a dynamic exclusion list, and that m/z value of the highest ion signal that was not in the exclusion list would be selected and activated to obtain its MS/MS spectrum in a subsequent data-dependent scan event. As a result, both the doubly-charged molecular ions of the few glutathione-trapped drug metabolites (which were the highest) and their singly-charged counter parts which were the next highest ions in the regions highlighted in FIG. 11*d* (1110, 1120, 1130), were alternatively selected and activated to get their respective MS/MS spectra (working principle to be further elaborated with FIGS. 8 & 9).

Example 3

This is another variation of Example 1. In addition to a data-dependent MS/MS acquisition function that was set following Method 600, another data-dependent function was set to perform fractionation of the LC effluent via a fractionation device 160*b*. The method of the data-dependent fractionation function was set following aforementioned Method 1000, dictating that real-time base peak ion chromatogram of the background-subtracted spectra of the precursor ion acquisition function would be processed to determine first order derivative values (with respect to time) characterizing fast-rising, fast-decreasing, or approaching apex or trough of a peak, and that the derivative values in combination with a intensity threshold setting (absolute value of 500 intensity counts) would determine the actions of start or stop of a fraction collection or change of a collection vial. As a consequence, the analysis of the control and test samples not only resulted in the obtaining of MS/MS spectra for the doubly-charged glutathione-trapped drug metabolites in the test sample as illustrated in Example 1, it also resulted in fraction collection of each of the peaks highlighted in FIG. 11*d* (1110, 1120, 1130). For each of the three peaks highlighted, the start action of fractionation was triggered by the fast-rising above the set intensity threshold and the stop action was triggered by fast-decreasing below the set intensity threshold. The data-dependent fractionattion obtained from this analysis allowed a follow-up study (nanospray MS3) to further characterize the metabolite ions detected in this analysis.

While the present invention has been described in some detail for purposes of clarity and understanding, it will be appreciated by one skilled in the art that, based on the disclosure of this application, various changes in form and detail is made without departing from the scope of the invention. The invention is therefore not to be limited to the exact components or details of methodology or construction set forth above. Except to the extent necessary or inherent in the processes themselves, no particular order to steps or stages of methods or processes described in this application, including the Figures, is intended or implied. In many cases the order of process steps is varied without changing the purpose, effect, or import of the methods described.

What is claimed is:

1. A method of analyzing mass spectrum of a sample containing at least one component of interest, comprising the steps of:

obtaining a background data set from a background sample different from the sample containing at least one component of interest, the background sample being a biological sample and comprising a plurality of biological background components, and the sample containing at least one component of interest being a biological sample and further comprising the plurality of biological background components;

after obtaining the background data set, performing a continuous chromatographic measurement of the sample containing at least one component of interest;

acquiring an original mass spectrum of the sample containing at least one component of interest with a first mass spectrometric acquisition function at a first chromatographic time point by using a mass spectrometer, wherein the original mass spectrum comprises m/z and intensity information of ion signals detected at the first chromatographic time point;

defining sections of data in the background data set at the first chromatographic time point specified in the acquiring step to form defined sections of the background data set, the defining comprises applying a chromatographic fluctuation time window and a mass precision window around ion signals in the background data set at the first chromatographic time point;

conducting background subtraction for ions in the original mass spectrum using ion information in the defined sections of the background data set, resulting in a current background-subtracted mass spectrum; and conducting an event of a data-dependent acquisition function of ion signals detected at a second subsequent chromatographic time point based on the current background-subtracted mass spectrum;

wherein the background subtraction occurs in real time before conducting the event of the data-dependent acquisition function at the second subsequent chromatographic time point, the first and second chromatographic time points are two time points in the continuous chromatographic measurement, and the data-dependent acquisition function is a subsequent mass spectrometric measurement or diversion of the sample containing at least one component of interest.

2. The method of claim 1, wherein the subtracting comprises substantially removing ion signals of background components from the original mass spectrum, thus allowing selective data-dependent acquisition for the at least one component of interest in the sample.

3. The method of claim 1, wherein the chromatographic fluctuation time window and the mass precision window are variable windows.

4. The method of claim 1, wherein the current background-subtracted mass spectrum is obtained through reconstruction of the original mass spectrum at the first chromatographic time point after subtracting ion signals of background components corresponding to the defined sections of the background data set from the original mass spectrum.

5. The method of claim 1, wherein the background subtraction is carried out by subtracting background data in the specified chromatographic fluctuation time window and mass precision window from the original mass spectrum of the sample at the first chromatographic time point.

6. The method of claim 1, further comprising the steps of:

obtaining at least one background data set comprising information on m/z of ions, chromatographic time, and ion peak intensity.

7. The method of claim 6, wherein the first mass spectrometric acquisition function is kept the same or equivalent as the acquisition of the background data set.

8. The method of claim 1, wherein the background subtraction comprises contrasting between ion peak intensities in the defined sections of the background data and ion peak intensities in the original mass spectrum of the sample containing at least one component of interest.

9. The method of claim 8, wherein the contrasting comprises dividing ion peak intensities in the original mass spectrum of the sample containing at least one component of interest by ion peak intensities in the defined sections of the background data.

10. The method of claim 1, wherein the background subtraction comprises applying a scale factor to intensities of the defined background data prior to conducting the subtracting.

11. The method of claim 1, further comprising choosing ion signal(s) at the first chromatographic time point for conducting the event of a data-dependent acquisition function, wherein the choosing is based on at least the information of the current background-subtracted mass spectrum, whereby the information of the current background-subtracted mass spectrum allows the event of the data-dependent acquisition function to be selective for the at least one component of interest in the sample.

12. The method of claim 11, wherein a choice of ion signal(s) is defined as the current highest intensity ion signal(s) in the current background-subtracted spectrum.

13. The method of claim 11, wherein a choice of ion signal(s) is selected from current fast-rising ion signals in background-subtracted mass spectral data of the first mass spectrometric acquisition function.

14. The method of claim 11, wherein the choice of ion signal is selected based on the fast rising peaks of a base peak ion chromatogram of background-subtracted mass spectral data of the first mass spectrometric acquisition function.

15. The method of claim 11, wherein the event of data-dependent acquisition function is a MS/MS acquisition event.

16. The method of claim 11, wherein the event of data-dependent acquisition function is diversion of the sample containing at least one component of interest, which comprises a sample fractionation event generating fractions for further analysis.

17. The method of claim 1, wherein the biological sample further comprises one or more components of interest selected from the ground consisting of drugs of abuse, metabolites, pharmaceuticals, forensic chemicals, pesticides, peptides, proteins, and nucleotides.

18. A system for analyzing a sample containing at least one component of interest, comprising:

a separation module for separating components in the sample containing at least one component of interest; and a mass spectrometer for detecting ions of components in the sample and acquiring a sample data set, the mass spectrometer comprising a data-dependent acquisition module and a system controller that comprises a background-subtracting module, and the system controller being configured to cause the system to perform the method of claim 1.

19. The system of claim 18, further comprising a data storage module where background data obtained from the background sample is stored prior to acquisition of the sample containing at least one component of interest.

20. The system of claim 19, wherein the background subtraction module accepts the sample data set from the mass spectrometer, retrieves the background data from the data storage module, and subtracts the background data from the sample data set by operation of a computing algorithm.

21. The system of claim 20, wherein the sample dataset is a precursor or parent mass dataset of the sample containing at least one component of interest.

22. The system of claim 20, wherein the background subtraction module subtracts the background data from the sample data set to generate a background-subtracted mass spectral data set consisting essentially of mass data of at least one component of interest, and the data-dependent acquisition module uses the background-subtracted mass spectral dataset to determine a choice of ion signal(s) to direct events of data-dependent acquisition function of the sample containing at least one component of interest in real time.

23. The system of claim 20, wherein said subtracting comprises subtracting a plurality of background data from a plurality of sample data sets before acquiring a plurality of subsequent data-dependent data sets of the sample containing at least one component of interest through interaction between the data-dependent acquisition module and the background subtraction module.

24. The system of claim 18, wherein the system is an LC-MS/MS system.

25. The system of claim 18, wherein the system comprises a high-resolution mass spectrometer.

26. A method of analyzing mass spectrum of a sample containing at least one component of interest, comprising the steps of:

obtaining a background data set from a background sample different from the sample containing at least one component of interest, the background sample being a biological sample and comprising a plurality of background components, and the sample containing at least one component of interest being a biological sample and further comprising the plurality of background components;

after obtaining the background data set, performing a continuous chromatographic measurement of the sample containing at least one component of interest;

acquiring an original mass spectrum of the sample containing at least one component of interest with a first mass spectrometric acquisition function at a first chromatographic time point by using a mass spectrometer, wherein the original mass spectrum comprises m/z and intensity information of ion signals detected at the first chromatographic time point;

defining sections of data in the background data set at the first chromatographic time point specified in the acquiring step to form defined sections of the background data set, the defining comprises applying a chromatographic fluctuation time window and a mass precision window around ion signals in the background data set at the first chromatographic time point;

conducting background subtraction for ions in the original mass spectrum using ion information in the defined sections of the background data set, resulting in a current background-subtracted mass spectrum; and conducting an event of a data-dependent acquisition function of ion signals detected at a second subsequent chromatographic time point based on the current background-subtracted mass spectrum;

wherein the background subtraction occurs in real time before conducting the event of the data-dependent acquisition function at the second subsequent chromatographic time point, the first and second chromatographic time points are two time points in the continuous chromatographic measurement, and the data-dependent acquisition function is a subsequent mass spectrometric measurement or diversion of the sample containing at least one component of interest; and wherein the subtracting comprises substantially removing ion signals of background components from the original mass spectrum, thus allowing selective data-dependent acquisition for the at least one component of interest in the sample.

27. A method of analyzing mass spectrum of a sample containing at least one component of interest, comprising the steps of:

obtaining a background data set from a background sample different from the sample containing at least one component of interest, the background sample being a biological sample and comprising a plurality of background components, and the sample containing at least one component of interest being a biological sample and further comprising the plurality of background components;

after obtaining the background data set, performing a continuous chromatographic measurement of the sample containing at least one component of interest;

acquiring an original mass spectrum of the sample containing at least one component of interest with a first mass spectrometric acquisition function at a first chromatographic time point by using a mass spectrometer, wherein the original mass spectrum comprises m/z and intensity information of ion signals detected at the first chromatographic time point;

defining sections of data in the background data set at the first chromatographic time point specified in the acquiring step to form defined sections of the background data set, the defining comprises applying a chromatographic fluctuation time window and a mass precision window around ion signals in the background data set at the first chromatographic time point;

conducting background subtraction for ions in the original mass spectrum using ion information in the defined sections of the background data set, resulting in a current background-subtracted mass spectrum; and conducting an event of a data-dependent acquisition function of ion signals detected at a second subsequent chromatographic time point based on the current background-subtracted mass spectrum;

wherein the background subtraction occurs in real time before conducting the event of the data-dependent acquisition function at the second subsequent chromatographic time point, the first and second chromatographic time points are two time points in the continuous chromatographic measurement, the data-dependent acquisition function is a subsequent mass spectrometric measurement or diversion of the sample containing at least one component of interest, and the background subtraction occurs each time before performing an immediate subsequent event of a data-dependent acquisition function.

28. A method of analyzing mass spectrum of a sample containing at least one component of interest, comprising the steps of:

obtaining a background data set from a background sample different from the sample containing at least one component of interest, the background sample being a biological sample and comprising a plurality of background components, and the sample containing at least one component of interest being a biological sample and further comprising the plurality of background components;

after obtaining the background data set, performing a continuous chromatographic measurement of the sample containing at least one component of interest;

acquiring an original mass spectrum of the sample containing at least one component of interest with a first mass spectrometric acquisition function at a first chromatographic time point by using a mass spectrometer, wherein the original mass spectrum comprises m/z and intensity information of ion signals detected at the first chromatographic time point;

defining sections of data in the background data set at the first chromatographic time point specified in the acquiring step to form defined sections of the background data set, the defining comprises applying a chromatographic fluctuation time window and a mass precision window around ion signals in the background data set at the first chromatographic time point;

conducting background subtraction for ions in the original mass spectrum using ion information in the defined sections of the background data set, resulting in a current background-subtracted mass spectrum; and conducting an event of a data-dependent acquisition function of ion signals detected at a second subsequent chromatographic time point based on the current background-subtracted mass spectrum;

wherein the background subtraction occurs in real time before conducting the event of the data-dependent acquisition function at the second subsequent chromatographic time point, the first and second chromatographic time points are two time points in the continuous chromatographic measurement, the data-dependent acquisition function is a subsequent diversion of the sample containing at least one component of interest.

* * * * *